US010994393B2

(12) United States Patent
Harada et al.

(10) Patent No.: US 10,994,393 B2
(45) Date of Patent: May 4, 2021

(54) ROTARY IMPACT TOOL

(71) Applicant: Koki Holdings Co., Ltd., Tokyo (JP)

(72) Inventors: Tetsuhiro Harada, Hitachinaka (JP); Tomomasa Nishikawa, Hitachinaka (JP); Tatsuya Ito, Hitachinaka (JP); Takahiro Hirai, Hitachinaka (JP); Yang Li, Hitachinaka (JP)

(73) Assignee: Koki Holdings Co., Ltd., Tokyo (JP)

( * ) Notice: Subject to any disclaimer, the term of this patent is extended or adjusted under 35 U.S.C. 154(b) by 308 days.

(21) Appl. No.: 16/070,083

(22) PCT Filed: Jan. 6, 2017

(86) PCT No.: PCT/JP2017/000276

§ 371 (c)(1),
(2) Date: Jul. 13, 2018

(87) PCT Pub. No.: WO2017/122592

PCT Pub. Date: Jul. 20, 2017

(65) Prior Publication Data

US 2019/0030692 A1 Jan. 31, 2019

(30) Foreign Application Priority Data

Jan. 14, 2016 (JP) ..... JP2016-004948

(51) Int. Cl.
*B25B 21/02* (2006.01)
*B25B 21/00* (2006.01)
(Continued)

(52) U.S. Cl.
CPC ..... *B25B 21/023* (2013.01); *B25B 21/008* (2013.01); *B25B 21/02* (2013.01); *B25B 23/1405* (2013.01); *B25B 23/1475* (2013.01)

(58) Field of Classification Search
CPC ..... B25B 21/02; B25B 21/023; B25B 21/008; B25B 23/1405; B25B 23/1475; B23B 45/16; B25D 16/00
(Continued)

(56) References Cited

U.S. PATENT DOCUMENTS

2006/0076832 A1* 4/2006 Matsushita ..... B62D 5/0487 307/10.1
2010/0096155 A1 4/2010 Kazutaka et al.
(Continued)

FOREIGN PATENT DOCUMENTS

CN 101641186 A 2/2010
JP 2013252579 A * 1/2006 ..... B25B 21/02
(Continued)

OTHER PUBLICATIONS

International Search Report for international application PCT/JP2017/000276 (dated Feb. 28, 2017) 10 pages with translation.
(Continued)

*Primary Examiner* — Hemant Desai
*Assistant Examiner* — Jacob A Smith
(74) *Attorney, Agent, or Firm* — Kilpatrick Townsend & Stockton LLP

(57) ABSTRACT

To provide a rotary impact tool capable of: suppressing a rise in temperature in a motor or switching elements and a current flowing in the motor or switching elements while suppressing a degradation in tightening performance; and improving operability. The rotary impact tool includes: a motor; an end-bit holding part driven by the motor; an impact mechanism provided on a drive transmission path from the motor to the end-bit holding part and configured to intermittently produce rotary impacts, the rotary impacts transmitting a drive force of the motor to the end-bit holding part; a switching element configured to change a voltage
(Continued)

supplied to the motor; and a control unit controlling the switching element. The control unit is configured such that the voltage supplied to the motor begins to gradually rise within a period of time from a timing when a first rotary impact ends to a timing when a second rotary impact subsequent to the first rotary impact starts.

9 Claims, 10 Drawing Sheets

(51) Int. Cl.
*B25B 23/14* (2006.01)
*B25B 23/147* (2006.01)

(58) Field of Classification Search
USPC ..... 173/11, 15, 16, 176
See application file for complete search history.

(56) References Cited

U.S. PATENT DOCUMENTS

2011/0214894 A1 9/2011 Harada et al.
2012/0279736 A1* 11/2012 Tanimoto ..... B25B 23/1475 173/2
2012/0306416 A1* 12/2012 Hano ..... B60L 1/003 318/400.26
2013/0025892 A1* 1/2013 Mashiko ..... B25B 21/02 173/2
2013/0126202 A1* 5/2013 Oomori ..... B25B 21/00 173/217
2014/0338939 A1* 11/2014 Shi ..... H02P 29/032 173/1
2015/0022125 A1* 1/2015 Takano ..... B25F 5/008 318/139
2015/0303842 A1* 10/2015 Takano ..... H02P 6/30 173/2
2016/0008961 A1* 1/2016 Takano ..... B25F 5/00 173/2
2016/0079887 A1* 3/2016 Takano ..... H02P 1/22 318/431
2016/0107297 A1 4/2016 Ishikawa et al.
2017/0008156 A1* 1/2017 Miyazaki ..... B25F 5/00
2018/0013369 A1* 1/2018 Fujii ..... H02P 25/022
2018/0117745 A1* 5/2018 Murakami ..... B25D 11/04
2018/0200872 A1* 7/2018 Leong ..... B25B 21/002

FOREIGN PATENT DOCUMENTS

JP 2009-072888 A 4/2009
JP 2009-72889 A 4/2009
JP 2009-269138 A 11/2009
JP 2012-139784 A 7/2012
JP 2013-146847 A 8/2013
JP 2013-252579 A 12/2013
JP 5792123 B2 10/2015
JP 2016-78230 A 5/2016

OTHER PUBLICATIONS

China Patent Office office action for patent application CN201780006835.X dated Jun. 14, 2019, 12 pages with translation.
International Report on Patentability for application PCT/JP2017/000276 (dated Jul. 26, 2018), 9 pages.

* cited by examiner

0°

45°

90°

135°

180°

225°

270°

315°

ROTARY IMPACT TOOL

TECHNICAL FIELD

The present invention relates to a rotary impact tool, and particularly to a rotary impact tool that intermittently outputs rotary impact forces.

BACKGROUND ART

A conventional rotary impact tool that converts the rotational force of a motor into intermittent rotary impact forces for performing operations to tighten screws or the like has been widely used. In rotary impact tools, the temperatures of the motor and the switching elements used to control the motor rises due to the large current that flows to the motor during each rotary impact and the current that flows in the interval between one rotary impact and a successive rotary impact. When the increase in temperature is considerable, there is concern that the motor and switching elements will degrade or fail. Accordingly, the suppression of rising temperatures in the motor and switching elements used to control the motor is a major issue.

One type of rotary impact tool described in Patent Literature 1 is an impact tool provided with an impact mechanism that rotates a hammer while reciprocating the same in an axial direction so that the hammer strikes an anvil. The impact tool in Patent Literature 1 controls power supply to the motor using a PWM signal (PWM control), driving the motor with the duty ratio of the PWM signal set to 100% and reducing the duty ratio when the current flowing in the motor exceeds a prescribed current value to suppress excessive retraction of the hammer. More specifically, the impact tool maintains the duty ratio at 100% until the electric current in the motor reaches the prescribed current value, reduces the duty ratio to 85% once the electric current in the motor exceeds the prescribed current value, and subsequently increases the duty ratio gradually over a plurality of successive impacts.

The type of rotary impact tool described in Patent Literature 2 is an impact tool provided with an impact mechanism that rotates a hammer while reciprocating the same in an axial direction so that the hammer strikes an anvil. The impact tool in Patent Literature 2 initially applies a first voltage to the motor during an interval after a local minimum of the motor speed is detected and before the hammer strikes, and then applies a second voltage smaller than the first voltage to suppress excessive retraction of the hammer. More specifically, the impact tool maintains the duty ratio for PWM control at 100% until just prior to impact, reduces the duty ratio to 70% just prior to the impact, and increases the duty ratio to 100% immediately after the impact.

The type of rotary impact tool described in Patent Literature 3 is an oil pulse tool provided with an oil pulse mechanism that generates an impact force by rotating a liner in order to intermittently increase the pressure state of oil confined between the liner and a shaft. The oil pulse tool described in Patent Literature 3 reduces the drive force of the motor when the liner is rotated in reverse by a reaction force produced immediately after impact and subsequently increases the drive force of the motor once the liner resumes rotating in the forward direction and passes the strike position, thereby reducing the electric current flowing in the motor. More specifically, the oil pulse tool reduces the duty ratio for PWM control from 100% to 75% just before the liner reaches the strike position, reduces the duty ratio to 50% when the liner begins rotating in reverse from the strike position due to the force of impact generated when the liner reaches the strike position, reduces the duty ratio to 25% when the liner once again rotates in the forward direction, and increases the duty ratio to 100% immediately after the liner passes the strike position. The oil pulse tool described in Patent Literature 3 has a special configuration that the liner of the oil pulse mechanism is connected to the rotor of the motor without going through a speed-reducing mechanism, and thus the torque applied to the liner by the motor is relatively small. Hence, this tool is characteristic in that a very brief rotary impact is produced when the liner reaches the strike position and, after the rotary impact is produced, the liner immediately rotates in reverse due to the reaction force from the impact. Accordingly, the above-described control is suitable for the rotary impact tool described in Patent Literature 3.

The type of rotary impact tool described in Patent Literature 4 is an electronic pulse tool provided with a pulse mechanism that forces a hammer to strike an anvil by repeatedly driving the motor and hammer in normal and reverse directions through electronic control. The electronic pulse tool described in Patent Literature 4 reduces the electric current flowing in the motor by limiting the duty ratio for PWM control for a prescribed time immediately after the rotating directions of the motor and hammer are switched and subsequently increasing the duty ratio gradually. More specifically, the electronic pulse tool gradually increases the duty ratio for PWM control to 100% while rotating the motor and hammer in the forward direction until just before impact, sets the duty ratio to 0% from the beginning of impact to the end of impact, maintains the duty ratio at 40% for the prescribed time while rotating the motor and hammer in reverse immediately after impact, and subsequently increases the duty ratio gradually to 100%.

CITATION LIST

Patent Literature

[PTL 1]
Japanese Patent Application Publication No. 2009-72889
[PTL 2]
Japanese Patent Application Publication No. 2009-72888
[PTL 3]
Japanese Patent Application Publication No. 2009-269138
[PTL 4]
Japanese Patent Application Publication No. 2012-139784

SUMMARY OF INVENTION

Technical Problem

However, since the impact tool described in Patent Literature 1 is configured to drive the motor with a duty ratio of 100%, a large current is constantly flowing in the motor and the temperatures in the motor and switching elements tends to rise markedly. Further, the impact tool described in Patent Literature 1 is configured to decrease, when the current flowing in the motor exceeds the prescribed current value, the duty ratio uniformly over a period of time for which a plurality of rotary impacts are consecutively produced. Therefore, while this configuration can suppress rising temperatures caused by increase of the current during impacts, the fastening performance of the tool is degraded.

Further, the impact tool according to Patent Literature 2 increases the duty ratio to 100% immediately after an impact. Consequently, a large current flows in the motor and switching elements, which tends to generate heat in the motor and switching elements.

Further, the oil pulse tool according to Patent Literature 3 raises the duty ratio to 100% immediately after the liner passes the strike position. Consequently, a large current flows in the motor and switching elements, which tends to generate heat in the motor and switching elements.

Further, the electronic pulse tool according to Patent Literature 4 limits the duty ratio for a prescribed time immediately after impact while rotating the motor and hammer in reverse, and then gradually increases the duty ratio. Accordingly, while the tool can suppress the electric current that flows to the motor and switching elements at this time, the rotational direction of the motor and hammer must be switched from reverse to forward, at which time a large current flows to the motor.

Therefore, it is an object of the present invention to provide a rotary impact tool capable of suppressing a rise in temperature in the motor or switching elements while suppressing a degradation in fastening performance. It is another object of the present invention to provide a rotary impact tool capable of reducing electric current flowing in the motor or switching elements while suppressing a degradation in fastening performance. It is another object of the present invention to provide a rotary impact tool with good operability.

Solution to Problem

In order to attain the above and other objects, the present invention provides a rotary impact tool including: a motor; an end-bit holding part driven by the motor; an impact mechanism provided on a drive transmission path from the motor to the end-bit holding part and configured to intermittently produce rotary impacts, the rotary impacts transmitting a drive force of the motor to the end-bit holding part; a switching element configured to change a voltage supplied to the motor; and a control unit controlling the switching element. The control unit is configured such that the voltage supplied to the motor begins to gradually rise within a period of time from a timing when a first rotary impact ends to a timing when a second rotary impact subsequent to the first rotary impact starts.

The inventors of the present invention discovered that the rotational speed of the impact mechanism just prior to the start of a rotary impact is one important factor that affects tightening performance in a rotary impact tool. That is, in order to acquire sufficient tightening performance in the second rotary impact, it is sufficient to accelerate the rotation of the impact mechanism to the desired rotational speed just prior to the start of the second rotary impact and unnecessary to raise the voltage supplied to the motor to the maximum value immediately after the first rotary impact has ended. Here, the rotational speed of the impact mechanism denotes the speed of an impact part, which is the member doing the impacting, relative to an impacted part, which is the member to be impacted. Using the embodiment described later as an example, a liner part 6A of an oil pulse unit 6 corresponds to the impact part, a striking shaft part 6B corresponds to the impacted part, and the rotational speed of the liner part 6A relative to the shaft part 6B corresponds to the rotational speed of the impact mechanism described above. By configuring the control unit to start to gradually increase the voltage supplied to the motor within a period of time from the end of the first rotary impact to the start of the second rotary impact as described above, the rotary impact tool can accelerate the impact mechanism while suppressing an excessive rise in current, thereby suppressing a temperature rise in the motor or switching elements while suppressing a degradation in tightening performance.

In the above configuration, it is preferable that the control unit is configured to start to gradually decrease the voltage supplied to the motor within a period of time from the timing when the second rotary impact subsequent to the first rotary impact starts to a timing when the second rotary impact ends.

In order to attain the above and other objects, the present invention further provides a rotary impact tool including: a motor; an end-bit holding part driven by the motor; an impact mechanism provided on a drive transmission path from the motor to the end-bit holding part and configured to intermittently produce rotary impacts, the rotary impact transmitting a drive force of the motor to the end-bit holding part; a switching element configured to change a voltage supplied to the motor; and a control unit controlling the switching element. The control unit is configured to start to gradually decrease the voltage supplied to the motor within a period of time from a timing when a second rotary impact subsequent to a first rotary impact starts to a timing when the second rotary impact ends.

The inventors of the present invention discovered that in order to achieve sufficient tightening performance it is sufficient for the motor to produce a large torque only for a limited time period within a period of time from the start of a rotary impact to the end of the rotary impact and unnecessary for the motor to produce a large torque continuously. By configuring the control unit to start to gradually decrease the voltage supplied to the motor within a period of time from the start of the second rotary impact to the end of the second rotary impact as described above, the rotary impact tool can suppress a rise in temperature in the motor or switching elements while suppressing a decline in tightening performance.

In the above configuration, it is preferable that the control unit is configured to control the voltage supplied to the motor so that, for a period of time from a timing when the first rotary impact ends to a timing when the second rotary impact starts, the voltage supplied to the motor alternates repeatedly between an increasing period and a decreasing period and voltage local maxima gradually rise, the voltage local maxima being values of the voltage at timings when the voltage transitions from the increasing period to the decreasing period.

With this configuration, since the voltage supplied to the motor alternates repeatedly between an increasing period and a decreasing period, the motor current flowing in the motor repeatedly increases and decreases. Accordingly, this configuration can suppress a rise in temperature in the motor or switching elements better than a configuration that supplies a constant large motor current by fixing the voltage supplied to the motor at 100%. Further, since the local maxima of the voltage supplied to the motor gradually increase, sufficient voltage is supplied to the motor. Accordingly, the rotational speed of the motor (rotational speed of the impact mechanism) is sufficiently increased within a period of time from the end of the first rotary impact to the start of the second rotary impact, thereby obtaining a sufficient rotary impact force. Thus, this configuration can suppress a decline in tightening performance while suppressing a rise in temperature in the motor or switching elements.

Further, in the above configuration, it is preferable: that the rotary impact tool further includes a current detecting unit configured to detect a motor current flowing to the motor; and that the control unit is configured to: when the motor current exceeds a target current value, gradually decrease the voltage supplied to the motor; and when the motor current is lower than or equal to the target current value, gradually increase the voltage supplied to the motor.

With this configuration, although the voltage supplied to the motor is decreased to reduce the motor current when the motor current rises abruptly during a rotary impact, the degree of this reduction can be reduced, thereby suppressing a degradation in tightening performance.

Further, in the configuration described above, it is preferable that the control unit is configured to: when a first work operation is performed by an end bit connected to the end-bit holding part, control the voltage supplied to the motor as described above; and when a second work operation in which a load imposed upon the motor is greater than that in the first work operation is performed: perform a control to decrease the voltage supplied to the motor; and after performing the control, gradually increase the voltage supplied to the motor over a period of time for which a plurality of rotary impacts are performed.

With this configuration, the motor current can be further reduced in comparison to a structure in which the voltage supplied to the motor is not once decreased when the second work operation is performed, thereby suppressing a rise in temperature in the motor or switching elements. Further, the motor current can be increased more than a configuration in which, when the second work operation is performed, tightening operations are performed in a state where the voltage supplied to the motor remains reduced, thereby suppressing a decline in tightening performance. In other words, this configuration can suppress a rise in temperature in the motor or switching elements while suppressing a degradation in tightening performance.

Further, in the configuration described above, it is preferable that the control unit is configured to: when a first work operation is performed by an end bit connected to the end-bit holding part, control the voltage supplied to the motor as described above; when the motor current exceeds a discrimination threshold value greater than the target current value, determine that a second work operation in which a load imposed upon the motor is larger than that in the first work operation is performed; and when the second work operation is performed: perform a control to decrease the voltage supplied to the motor; and after performing the control, gradually increases the voltage supplied to the motor over a period of time for which a plurality of rotary impacts are produced.

With this configuration, the discrimination threshold value greater than the target current value is used for discriminating that the second work operation is performed. Accordingly, it can be satisfactorily discriminated that the second work operation causing a large current to flow is performed.

Further, in the configuration described above, it is preferable that the control unit is configured to, when the second work operation is performed: decrease the voltage supplied to the motor to a first prescribed value; after decreasing the voltage to the first prescribed value, increase the voltage from the first prescribed value to a second prescribed value over a prescribed period of time, the second prescribed value being larger than the first prescribed value; and after the prescribed period of time elapses, decrease the voltage to a third prescribed value lower than the first prescribed value.

With this configuration, after the prescribed period of time has elapsed from a timing when the second work operation is performed, the voltage supplied to the motor is decreased to the third prescribed value lower than the first prescribed value. Accordingly, a large motor current does not flow after the prescribed period of time has elapsed, thereby better suppressing a rise in temperature in the motor or switching elements.

Further, in the configuration described above, it is preferable that the control unit is configured to control the voltage supplied to the motor so that a period of the rotary impacts intermittently produced is irregular.

With this configuration, the period of rotary impacts does not resonate with mechanisms or the like used in the rotary impact tool, thereby reducing vibrations generated in the rotary impact tool and improving operability.

In order to attain the above and other objects, the present invention further provides a rotary impact tool including: a motor; an end-bit holding part driven by the motor; an impact mechanism provided on a drive transmission path from the motor to the end-bit holding part and configured to intermittently produce rotary impacts, the rotary impacts transmitting a drive force of the motor to the end-bit holding part; a switching element configured to change a voltage supplied to the motor; and a control unit controlling the switching element. The control unit is configured to gradually increase the voltage supplied to the motor over a period of time for which a plurality of rotary impacts are produced.

With this configuration, the voltage supplied to the motor and the tightening performance become greater as a period of time during which a tightening operation is performed become longer. When a load is small such as in a case where a tightening operation is performed with a wood screw and the like, the wood screw and the like can be sufficiently tightened to the member to be fastened by driving the motor with a low voltage for a short time. Even when the tightening by this short time tightening operation is insufficient, the voltage supplied to the motor and the tightening performance can be gradually increased by continuing the tightening operation. Accordingly, even when the load of the member to be fastened is larger than expected, the tightening operation can be completed with without interruption thereof, thereby providing a rotary impact tool with improved operability.

In the configuration described above, it is preferable: that the rotary impact tool further includes a current detecting unit configured to detect a motor current flowing to the motor; and that the control unit is configured to, when the motor current exceeds a discrimination threshold value: perform a control to decrease the voltage supplied to the motor; and after performing the control to decrease the voltage, gradually increase the voltage supplied to the motor over the period of time for which the plurality of rotary impacts are produced.

With this configuration, the motor current can be further reduced in comparison to a configuration in which the voltage supplied to the motor is not decreased, thereby suppressing a rise in temperature in the motor or switching elements. Further, the motor current can be increased more than a configuration in which tightening operations are performed in a state where the voltage supplied to the motor remains reduced, thereby suppressing a decline in tightening performance. In other words, this configuration can suppress a rise in temperature in the motor or switching elements while suppressing a degradation in tightening performance.

Further, in the configuration described above, it is preferable that the control unit is configured to: when the motor current exceeds a discrimination threshold value, decrease the voltage supplied to the motor to a first prescribed value; after decreasing the voltage to the first prescribed value, increase the voltage from the first prescribed value to a second prescribed value over a prescribed period of time, the second prescribed value being larger than the first prescribed value; and after the prescribed period of time elapses, decrease the voltage to a third prescribed value lower than the first prescribed value.

With this configuration, the motor current can be further reduced in comparison to a structure in which the voltage supplied to the motor is not once decreased when the motor current exceeds the discrimination threshold value, thereby suppressing a rise in temperature in the motor or switching elements. Further, the motor current can be increased more than a configuration in which, when the motor current exceeds a discrimination threshold value, tightening operations are performed in a state where the voltage supplied to the motor remains reduced, thereby suppressing a decline in tightening performance. In other words, this configuration can suppress a rise in temperature in the motor or switching elements while suppressing a degradation in tightening performance. Still further, since the voltage supplied to the motor is decreased to the third prescribed value lower than the first prescribed value after the prescribed period of time has elapsed, a large motor current does not flow after the prescribed period of time has elapsed. Accordingly, a rise in temperature in the motor or switching elements can be further suppressed.

Further, in the configuration described above, it is preferable that the control unit is configured to, when the motor current is lower than or equal to the discrimination threshold value: start to gradually increase the voltage supplied to the motor within a period of time from a timing when a first rotary impact ends to a timing when a second rotary impact subsequent to the first rotary impact starts; and start to gradually decrease the voltage supplied to the motor within a period of time from a timing when the second rotary impact to a timing when the second rotary impact ends.

With this configuration, since the control unit is configured to start to gradually increase the voltage supplied to the motor within a period of time from a timing when a first rotary impact ends to a timing when a second rotary impact subsequent to the first rotary impact starts, the rotary impact tool can accelerate the impact mechanism while suppressing an excessive rise in current. Accordingly, this configuration can suppress a temperature rise in the motor or switching elements while suppressing a degradation in tightening performance. Further, the control unit is configured to start to gradually decrease the voltage supplied to the motor within a period of time from a timing when the second rotary impact to a timing when the second rotary impact ends, thereby suppressing a temperature rise in the motor or switching elements while suppressing a degradation in tightening performance.

Further, in the configuration described above, it is preferable that the control unit is configured to control the voltage supplied to the motor so that, for a period of time from a timing when a first rotary impact in the plurality of rotary impacts intermittently performed ends to a timing when a second rotary impact subsequent to the first rotary impact starts, the voltage supplied to the motor alternates repeatedly between an increasing period and a decreasing period and voltage local maxima gradually rise, the voltage local maxima being values of the voltage at timings when the voltage transits from the increasing period to the decreasing period.

With this configuration, since the voltage supplied to the motor alternates repeatedly between an increasing period and a decreasing period, the motor current flowing in the motor repeatedly increases and decreases. Accordingly, this configuration can suppress a rise in temperature in the motor or switching elements better than a configuration that supplies a constant large motor current by fixing the voltage supplied to the motor at 100%. Further, since the local maxima of the voltage supplied to the motor gradually increase, sufficient voltage is supplied to the motor. Accordingly, the rotational speed of the motor (rotational speed of the impact mechanism) is sufficiently increased within a period of time from the end of the first rotary impact to the start of the second rotary impact, thereby obtaining a sufficient rotary impact force. Thus, this configuration can suppress a decline in tightening performance while suppressing a rise in temperature in the motor or switching elements.

Further, in the configuration described above, it is preferable that the control unit is configured to, when the motor current is lower than or equal to the discrimination threshold value: gradually decrease, when the motor current exceeds a target current value lower than the discrimination threshold value, the voltage supplied to the motor; and gradually increase, when the motor current is lower than or equal to the target current value, the voltage supplied to the motor.

With this configuration, although the voltage supplied to the motor is decreased to reduce the motor current when the motor current rises abruptly during a rotary impact, the degree of this reduction can be reduced, thereby suppressing a degradation in tightening performance.

Further, in the configuration described above, it is preferable that the control unit is configured to control the voltage supplied to the motor so that a period of the rotary impacts intermittently produced is irregular.

With this configuration, the period of rotary impacts does not resonate with mechanisms or the like used in the rotary impact tool, thereby reducing vibrations generated in the rotary impact tool and improving operability.

Advantageous Effects of Invention

The rotary impact tool according to the present invention is capable of suppressing a rise in temperature in a motor or switching elements while suppressing a degradation in tightening performance. Further, the rotary impact tool according to the present invention is capable of suppressing a current flowing in the motor or the switching elements while suppressing a degradation in tightening performance. Still further, the rotary impact tool according to the present invention is capable of improving operability.

BRIEF DESCRIPTION OF DRAWINGS

FIG. 3(*a*) illustrates a case in which a relative rotation angle of a liner part to a striking shaft part is 0°. FIG. 3(*b*) illustrates a case in which the relative rotation angle of the liner part to the striking shaft part is 180°.

FIG. 5(*a*) illustrates a case of 0°, FIG. 5(*b*) illustrates a case of 45°, FIG. 5(*c*) illustrates a case of 90°, FIG. 5(*d*) illustrates a case of 135°, FIG. 5(*e*) illustrates a case of 180°, FIG. 5(*f*) illustrates a case of 225°, FIG. 5(*g*) illustrates a case of 270°, and FIG. 5(*h*) illustrates a case of 315°.

DESCRIPTION OF EMBODIMENTS

Next, an embodiment of the present invention will be described while referring to the accompanying drawings. Note that when specific numerical values are referenced in the following description, such as when an angle is referred to as "90°," the reference is meant to include cases in which the value is approximately equivalent to this numerical value and not only cases in which the value is perfectly equal to this numerical value. Further, when the description references positional relationships and the like, such as parallel, orthogonal, opposite, and other relationships, the references are meant to include cases that are approximately parallel, approximately orthogonal, approximately opposite, and the like and not just cases that are perfectly parallel, perfectly orthogonal, perfectly opposite, and the like.

Figure 1:
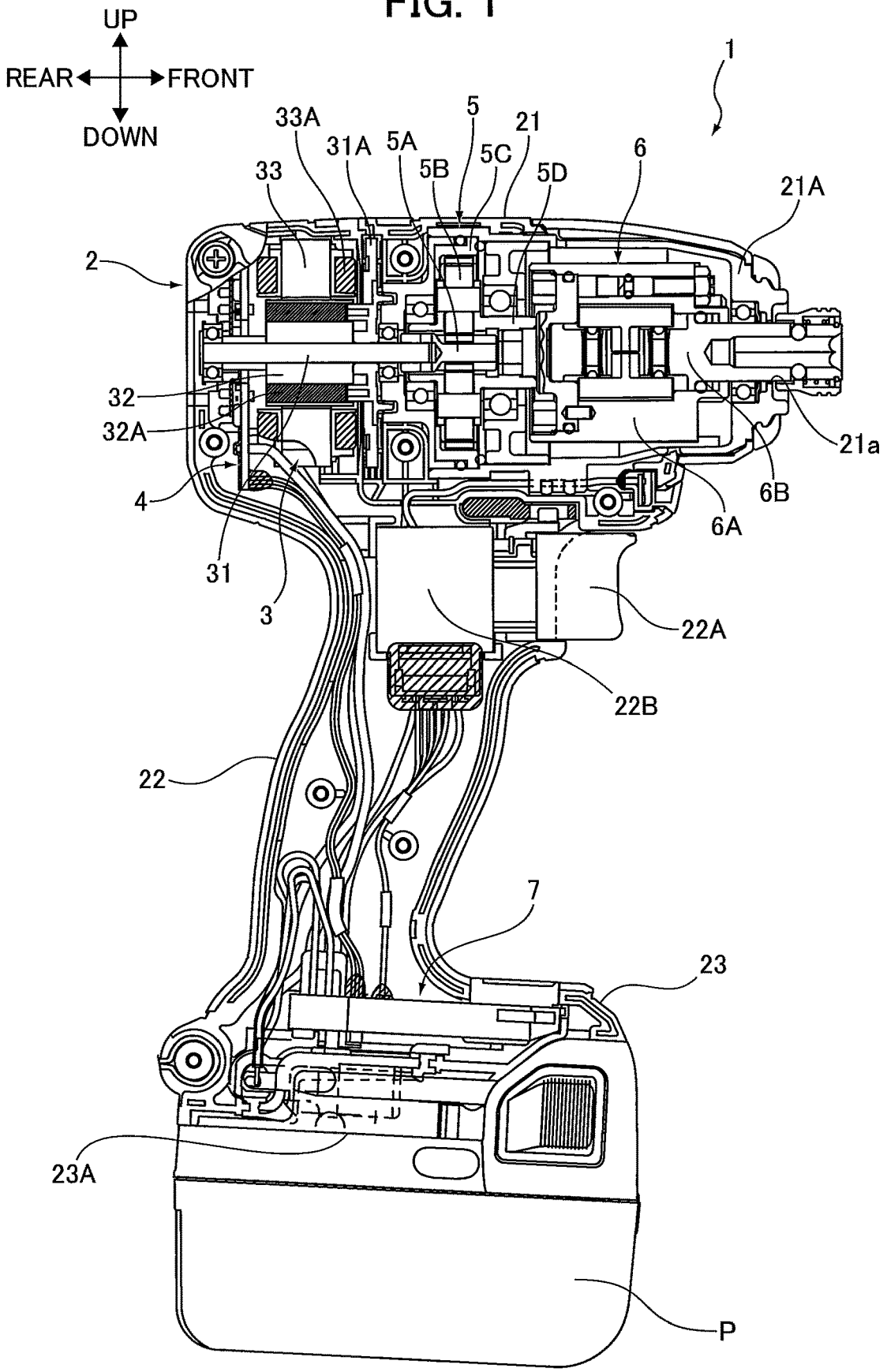
FIG. 1 is a partial cross-sectional side view illustrating an overall oil pulse driver according to an embodiment of the present invention.

FIG. 1 is a partial cross-sectional side view illustrating an overall oil pulse driver 1 as an example of the rotary impact tool according to the embodiment of the present invention. FIG. 1 illustrates a state in which a battery pack P is attached to the oil pulse driver 1. The oil pulse driver 1 is a tool that performs operations to tighten wood screws, bolts, and the like. As illustrated in FIG. 1, the oil pulse driver 1 is provided with a housing 2, a brushless motor 3, an annular circuit board 4, a speed reducing mechanism 5, an oil pulse unit 6, and a control board unit 7. In FIG. 1, "front," "rear," "up," and "down" indicated by arrows define the forward direction, rearward direction, upward direction, and downward direction, respectively. The leftward direction and rightward direction are defined as the left and right of the oil pulse driver 1 when viewing the oil pulse driver 1 from the rear.

The housing 2 forms the outer shell of the oil pulse driver 1 and has a motor accommodating section 21, a handle section 22, and a circuit board accommodating section 23.

The motor accommodating section 21 has a generally cylindrical shape that is elongated in the front-rear direction and accommodates the brushless motor 3, annular circuit board 4, speed reducing mechanism 5, and oil pulse unit 6. A mechanism case 21A is also provided in the inner front portion of the motor accommodating section 21. The mechanism case 21A has a diameter that grows gradually narrower toward the front. An opening 21*a* is formed in the front end portion of the mechanism case 21A.

The brushless motor 3 is accommodated in the rear portion of the motor accommodating section 21 and has a rotational shaft 31, a rotor 32, and a stator 33. The rotational shaft 31 extends in the front-rear direction and is rotatably supported to the motor accommodating section 21 via bearings. A cooling fan 31A is provided on the front portion of the rotational shaft 31. The cooling fan 31A is a centrifugal fan that rotates upon the rotation of the rotational shaft 31 and produces cooling air inside the motor accommodating section 21 to cool the brushless motor 3, annular circuit board 4, and the like. The rotor 32 has a plurality of permanent magnets 32A. The rotor 32 is fixed on the rotational shaft 31 and is configured to rotate together with the same. The stator 33 has stator windings 33A. The stator 33 is fixed in the motor accommodating section 21. The electrical configuration of the brushless motor 3 will be described later in greater detail. The brushless motor 3 is an example of the "motor" in the present invention.

The annular circuit board 4 has an annular shape in a rear side view and is disposed to the rear of the stator 33 in the brushless motor 3. An insertion hole is also formed in the center of the annular circuit board 4 in a rear side view. The insertion hole penetrates the annular circuit board 4 in the front-rear direction. The rear portion of the rotational shaft 31 is inserted through the insertion hole. The electrical configuration of the annular circuit board 4 will be described later in greater detail.

The speed reducing mechanism 5 is a planetary gear mechanism that transmits the rotation of the rotational shaft 31 in the brushless motor 3 (rotor 32) to the oil pulse unit 6 while reducing the rotational speed. The speed reducing mechanism 5 is provided with: a sun gear 5A that rotates integrally with the rotational shaft 31; a planetary gear 5B that meshingly engages with the sun gear 5A; a ring gear 5C that is fixed to the motor accommodating section 21 and engaged with the planetary gear 5B; and a carrier 5D that is connected to both the planetary gear 5B and the oil pulse unit 6 and is configured to rotate coaxially with the rotational shaft 31. The rotation of the rotational shaft 31 is converted to circular movement of the planetary gear 5B via the sun gear 5A, and the circular movement is transmitted to the oil pulse unit 6 via the carrier 5D. Through this configuration, the rotation of the rotational shaft 31 is transmitted to the oil pulse unit 6 at a reduced speed.

The oil pulse unit 6 is a mechanism that converts the rotational force of the rotational shaft 31 of the brushless motor 3 (the rotor 32) to an intermittent rotary impact force and outputs this force. The oil pulse unit 6 is accommodated inside the mechanism case 21A. The oil pulse unit 6 is provided with a liner part 6A connected to the speed reducing mechanism 5, and a striking shaft part 6B capable of holding an end bit (not illustrated). In the oil pulse unit 6, an intermittent rotary impact force is generated in the striking shaft part 6B holding the end bit by rotating the liner part 6A relative to the striking shaft part 6B. The oil pulse driver 1 uses these intermittent rotary impact forces to perform operations for tightening wood screws, bolts, and the like. The end bit in the present embodiment is a screwdriver bit, a bolt tightening bit, or the like. The oil pulse unit 6 will be described later in greater detail.

The handle section 22 is a portion that extends downward from the approximate front-rear center of the motor accommodating section 21 and is gripped by the user. The handle section 22 is provided with a trigger switch 22A that the user can operate, and a switch mechanism 22B. The trigger switch 22A is disposed on the front portion of the upper end portion of the handle section 22 and is connected to the switch mechanism 22B inside the handle section 22. The switch mechanism 22B is also connected to the control board unit 7. When the trigger switch 22A is pressed inward (turned on), the switch mechanism 22B outputs a start signal to the control board unit 7.

Figure 6:
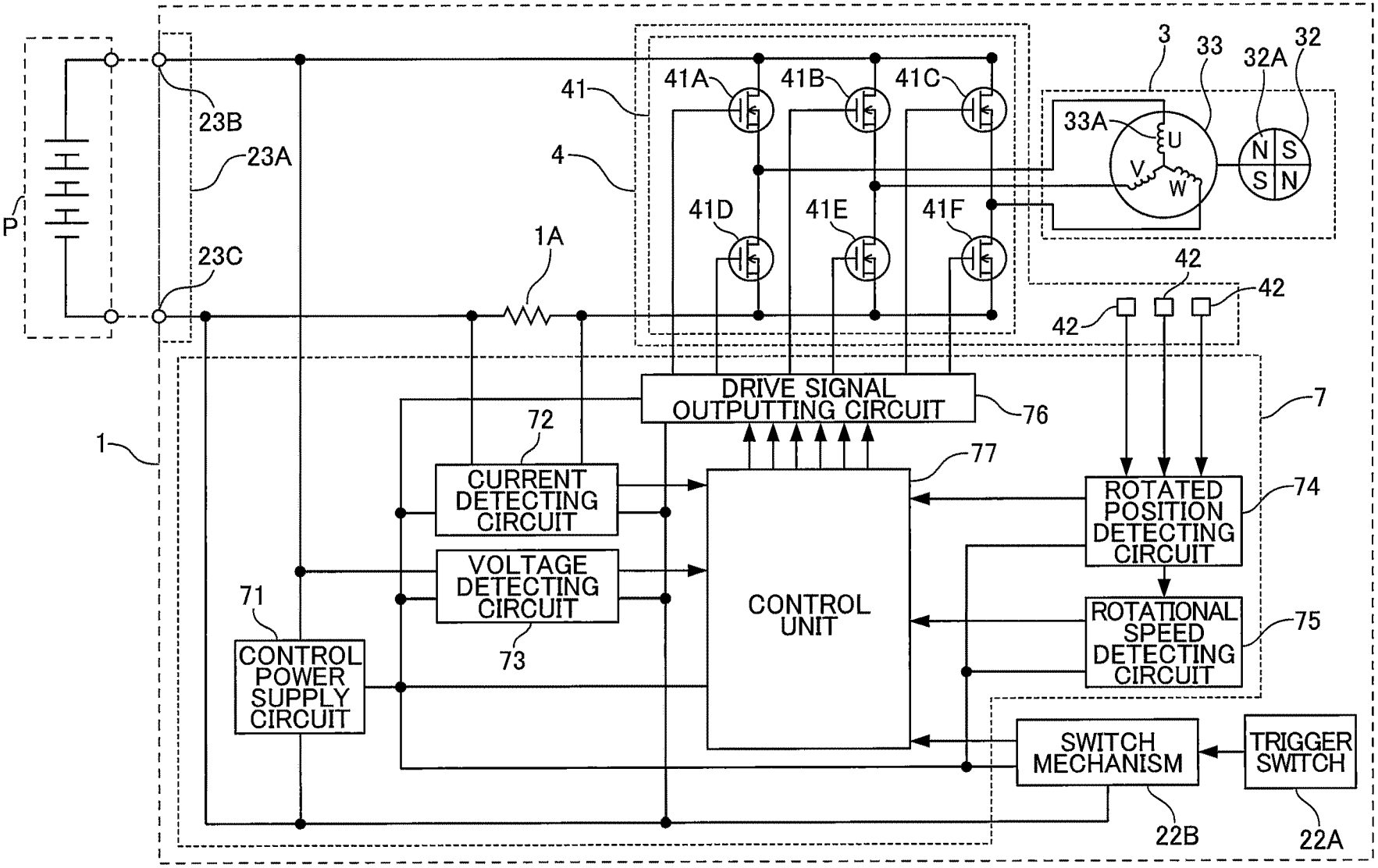
FIG. 6 is a circuit diagram that includes a block diagram illustrating an electrical structure of the oil pulse driver according to the embodiment of the present invention.

The circuit board accommodating section 23 is connected to the bottom end of the handle section 22 and accommodates the control board unit 7. A battery connector 23A configured for detachably retaining the battery pack P is formed on the bottom portion of the circuit board accommodating section 23. The battery connector 23A has a positive connection terminal 23B, and a negative connection terminal 23C (FIG. 6). The electrical structure of the control board unit 7 will be described later in greater detail.

The battery pack P accommodates a battery assembly including secondary batteries for powering the brushless motor 3, annular circuit board 4, and control board unit 7. The battery assembly is configured to be connected to the positive connection terminal 23B and negative connection terminal 23C in a state where the battery pack P is attached to (connected to) the battery connector 23A. In the present embodiment, the secondary batteries are lithium-ion secondary batteries.

Figure 2:
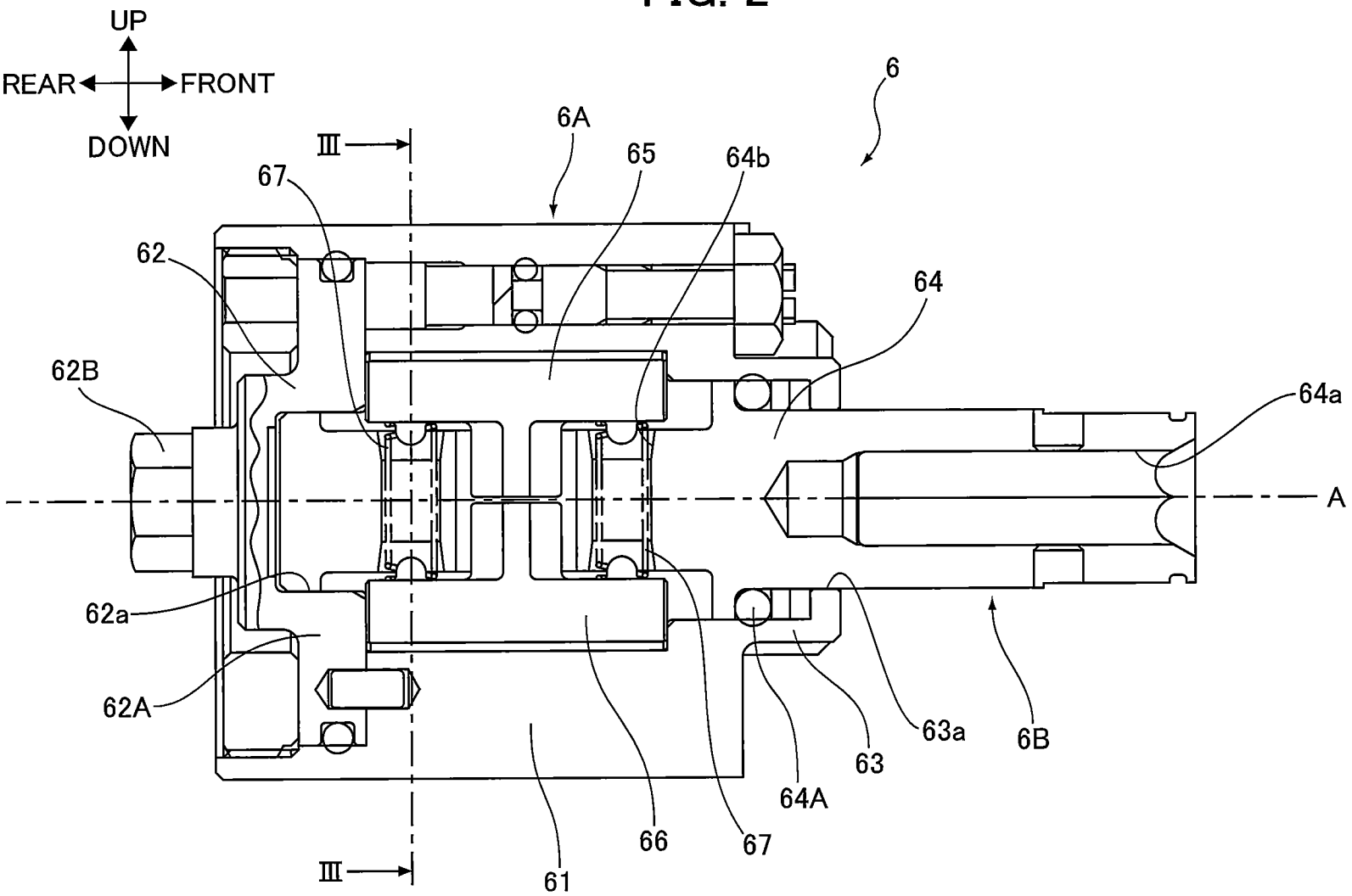
FIG. 2 is a partial enlarged view of FIG. 1 illustrating an oil pulse unit of the oil pulse driver according to the embodiment of the present invention.
Figure 3A:
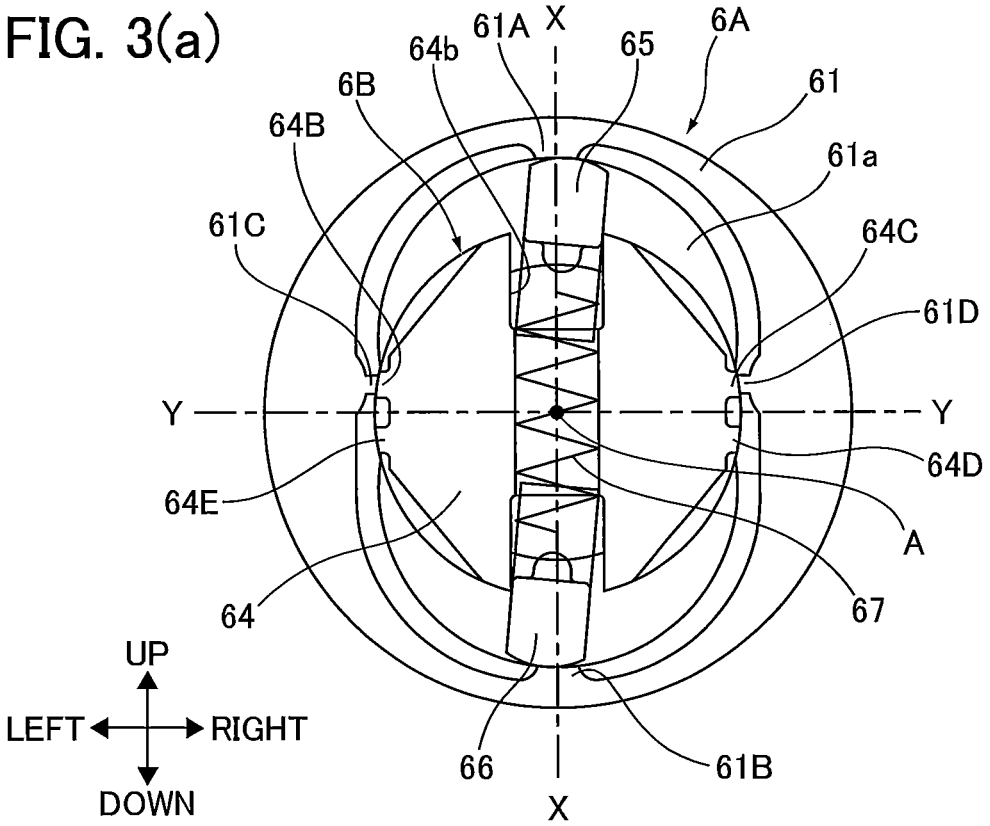
FIG. 3 is a cross-sectional view taken along the line in FIG. 2 illustrating the oil pulse unit of the oil pulse driver according to the embodiment of the present invention.
Figure 3B:
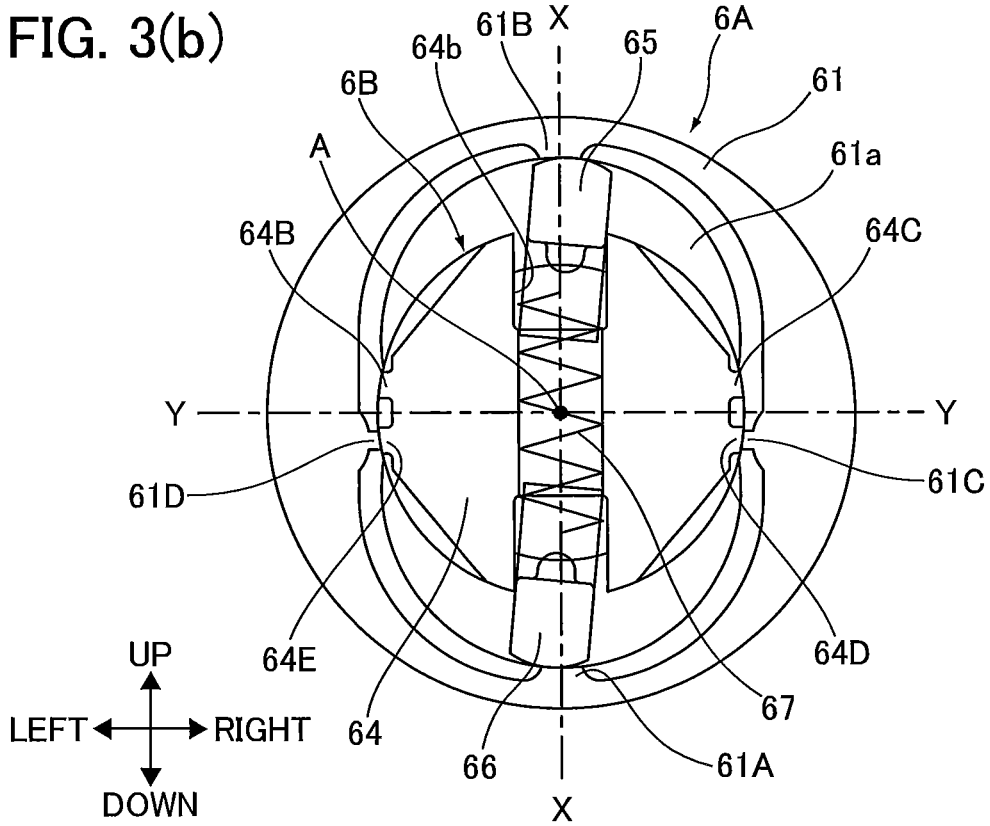

Here, the oil pulse unit 6 will be described in detail while referring to FIGS. 2-4. FIG. 2 is a partial enlarged view of FIG. 1 and illustrates the oil pulse unit 6. FIG. 3 is a cross-sectional view of the oil pulse unit 6 taken along the line in FIG. 2. For the convenience of description, the state of the liner part 6A illustrated in FIG. 3(*a*) will be defined as a rotation angle of 0° relative to the striking shaft part 6B. In the state of the liner part 6A illustrated in FIG. 3(*b*), the rotation angle of the liner part 6A relative to the striking shaft part 6B is 180°. Further, a rotational axis A illustrated in FIGS. 2 and 3 represents the rotational axis of the rotational shaft 31 (the carrier 5D).

As illustrated in FIG. 2, the liner part 6A of the oil pulse unit 6 is provided with a main cylindrical part 61 having a cylindrical shape that is elongated in the front-rear direction, a connecting plate 62 that closes the rear portion of the main cylindrical part 61, and a cylindrical end part 63 provided on the front end of the main cylindrical part 61. The liner part 6A is disposed so as to be capable of rotating about the rotational axis A. As illustrated in FIGS. 3(*a*) and 3(*b*), a liner chamber 61*a* is also defined inside the liner part 6A by the inner peripheral surface of the main cylindrical part 61 and the like. The liner chamber 61*a* is filled with oil (hydraulic oil).

As illustrated in FIGS. 3(*a*) and 3(*b*), the inner circumferential surface of the main cylindrical part 61 defines a substantially elliptic shape in a rear side view. Formed on this inner circumferential surface are a first projecting part 61A, a second projecting part 61B, a first protrusion 61C, and a second protrusion 61D. In FIGS. 3(*a*) and 3(*b*), the major axis of the substantially elliptical shape defined by the inner circumferential surface of the main cylindrical part 61 is indicated by a virtual major axis line X-X, and the minor axis is indicated by a virtual minor axis line Y-Y.

The first projecting part 61A protrudes from the inner circumferential surface of the main cylindrical part 61 inward in a radial direction thereof and is elongated in the front-rear direction. In a rear side view, the first projecting part 61A is positioned on the virtual major axis line X-X. The second projecting part 61B has a shape identical to the first projecting part 61A and is configured to be symmetrical to the first projecting part 61A relative to the rotational axis A.

The first protrusion 61C protrudes from the inner circumferential surface of the main cylindrical part 61 inward in the radial direction thereof and is elongated in the front-rear direction. In a rear side view, the first protrusion 61C is positioned slightly to the first projecting part 61A side of the virtual minor axis line Y-Y. The second protrusion 61D has a shape identical to the first protrusion 61C. The second protrusion 61D is configured to be symmetrical to the first protrusion 61C relative to a virtual plane that includes the virtual major axis line X-X and is orthogonal to the virtual minor axis line Y-Y. In a rear side view, the first protrusion 61C and second protrusion 61D are positioned slightly above the virtual minor axis line Y-Y in the state illustrated in FIG. 3(*a*) (at the relative rotation angle of 0°) and are positioned slightly lower than the virtual minor axis line Y-Y in the state illustrated in FIG. 3(*b*) (at the relative rotation angle of 180°).

Returning to FIG. 2, the connecting plate 62 is provided with a disk part 62A, and a connecting part 62B. The disk part 62A is the portion that closes the rear portion of the main cylindrical part 61 and has a circular shape in a rear side view. A bearing hole 62*a* that is recessed rearward is formed in the front surface of the disk part 62A. The connecting part 62B has a substantially hexagonal prism shape that is elongated in the front-rear direction. The connecting part 62B is fixed to the rear surface of the disk part 62A in the approximate center thereof and is connected to the carrier 5D of the speed reducing mechanism 5 so as to be incapable of rotating relative to the same. With this arrangement, the liner part 6A rotates integrally with the carrier 5D about the rotational axis A.

The cylindrical end part 63 is a portion formed continuously with the main cylindrical part 61. The cylindrical end part 63 has a cylindrical shape and extends forward from the front end of the main cylindrical part 61. The outer diameter of the cylindrical end part 63 is smaller than the outer diameter of the main cylindrical part 61. An opening 63*a* is formed in the front end of the cylindrical end part 63.

Figure 4:
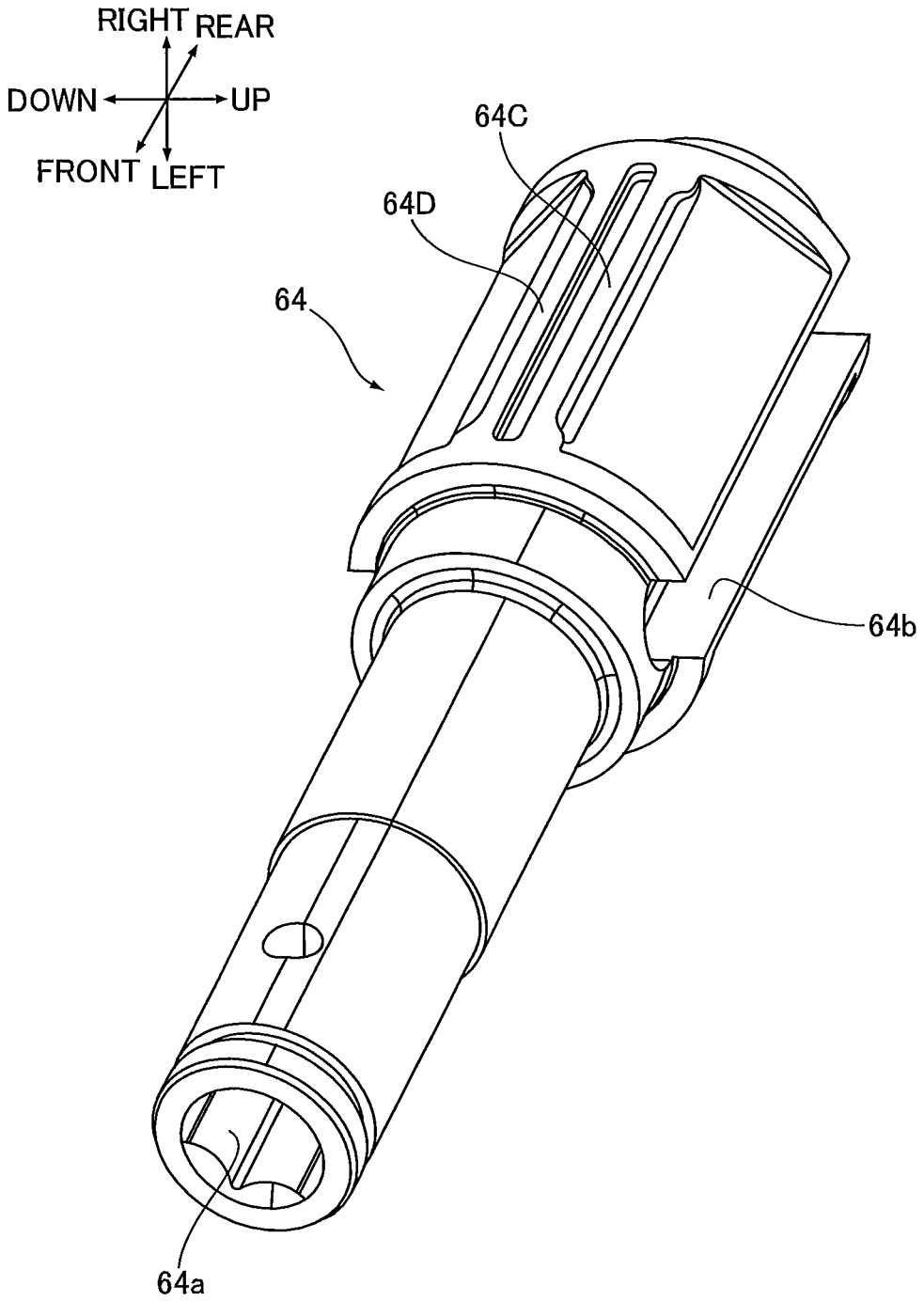
FIG. 4 is a perspective view of a main shaft of the oil pulse unit in the oil pulse driver according to the embodiment of the present invention.
Figure 5A:
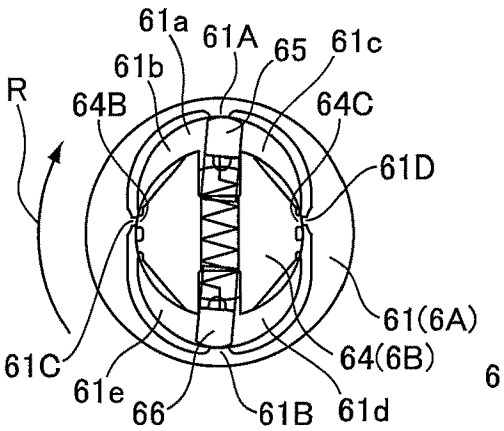
FIG. 5 illustrates the operation of the oil pulse unit when the relative rotation angle of the liner part 6A to the striking shaft part 6B.
Figure 5B:
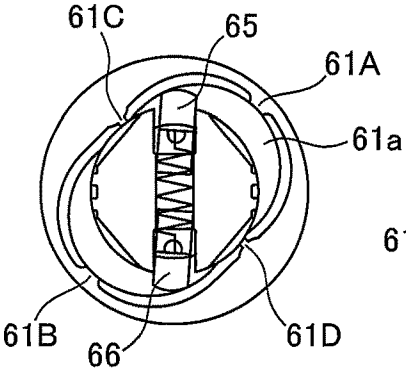
Figure 5C:
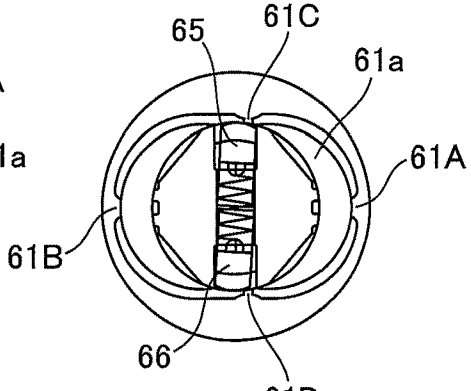
Figure 5D:
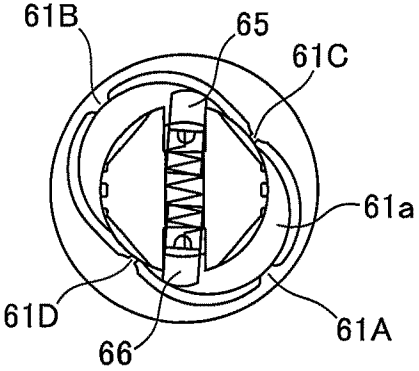
Figure 5E:
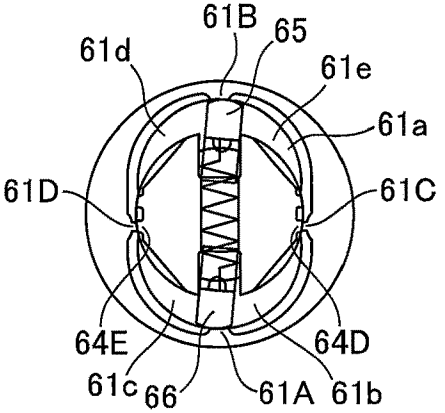
Figure 5F:
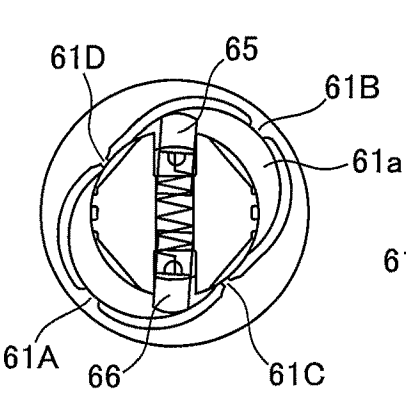
Figure 5G:
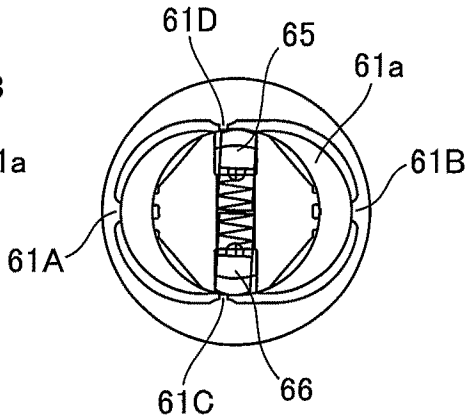
Figure 5H:
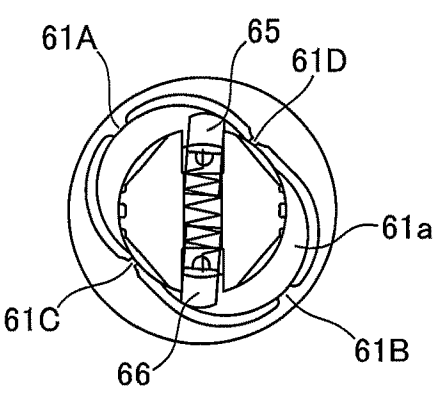

As illustrated in FIGS. 2-4, the striking shaft part 6B of the oil pulse unit 6 is provided with a main shaft 64, a first blade 65, and a second blade 66. FIG. 4 is a perspective view of the main shaft 64.

As illustrated in FIGS. 2 and 4, the main shaft 64 has a general columnar shape that is elongated in the front-rear direction. The front portion of the main shaft 64 protrudes forward through the opening 63*a* of the liner part 6A and the opening 21*a* (see FIG. 1) of the mechanism case 21A. The rear portion of the main shaft 64 is accommodated inside the liner chamber 61*a*. Further, a retaining hole 64*a* in which an end bit is inserted is formed in the front portion of the main shaft 64 so as to be recessed rearward from the front end of the same. The rear end portion of the main shaft 64 is inserted into the bearing hole 62*a* of the liner part 6A. Further, an O-ring 64A formed of a rubber is provided between the approximate front-rear center portion of the main shaft 64 and the inner circumferential surface of the cylindrical end part 63 constituting the liner part 6A. In other words, the main shaft 64 is rotatably supported to the liner part 6A via the bearing hole 62*a*, and the O-ring 64A prevents oil inside the oil pulse unit 6 from leaking out of the same to the outside. Note that the rotational axis of the main shaft 64 is approximately aligned with the rotational axis A.

As illustrated in FIGS. 3 and 4, a shaft through-hole 64*b* is also formed in the rear portion of the main shaft 64 accommodated in the liner chamber 61*a*. The shaft through-hole 64*b* is elongated in the front-rear direction and penetrates the rear portion of the main shaft 64 radially so as to pass through the center of the main shaft 64 (the rotational axis A). Formed on the outer circumferential surface of the rear portion of the main shaft 64 are a first seal projecting part 64B, a second seal projecting part 64C, a third seal projecting part 64D, and a fourth seal projecting part 64E that extend in the front-rear direction and protrude outward along radial directions of the main shaft 64.

The first seal projecting part 64B is formed at a position facing the first protrusion 61C in the state of FIG. 3(*a*) (at the relative rotation angle of 0°). The second seal projecting part 64C has a shape identical to the first seal projecting part 64B and is formed at a position facing the second protrusion 61D of the liner part 6A in the state of FIG. 3(*a*). Note that, in a state in which the first seal projecting part 64B and second seal projecting part 64C respectively face the first protrusion 61C and second protrusion 61D, slight gaps are formed between these members.

The third seal projecting part 64D is formed at a position facing the first protrusion 61C in the state of FIG. 3(*b*) (at the relative rotation angle of 180°). The fourth seal projecting part 64E is formed at a position facing the second protrusion 61D in the state of FIG. 3(*b*). Note that, in a state in which the third seal projecting part 64D and fourth seal projecting part 64E respectively face the first protrusion 61C and second protrusion 61D, slight gaps are formed between these members.

As illustrated in FIGS. 2 and 3, the first blade 65 and second blade 66 are identical members formed in a general plate shape that is elongated in the front-rear direction. The first blade 65 and second blade 66 are disposed at the shaft through-hole 64*b* so as to be capable of reciprocating in the radial direction of the main shaft 64. Springs 67 are disposed between the first blade 65 and second blade 66. The springs 67 urge the first blade 65 and second blade 66 outward in the radial direction of the main shaft 64. In the state of FIG. 3(*a*), the outer radial end of the first blade 65 is in contact with the first projecting part 61A of the liner part 6A and the outer radial end of the second blade 66 is in contact with the second projecting part 61B. Further, in the state of FIG. 3(*b*), the outer radial end of the first blade 65 is in contact with the second projecting part 61B of the liner part 6A and the outer radial end of the second blade 66 is in contact with the first projecting part 61A.

Here, the operation of the oil pulse unit 6 and the occurrence of intermittent rotary impact forces in the oil pulse unit 6 will be described with reference to FIG. 5. FIG. 5 illustrates the operation of the oil pulse unit 6 when the relative rotation angle of the liner part 6A to the striking shaft part 6B. FIG. 5(*a*) illustrates a case of 0°, FIG. 5(*b*) illustrates a case of 45°, FIG. 5(*c*) illustrates a case of 90°, FIG. 5(*d*) illustrates a case of 135°, FIG. 5(*e*) illustrates a case of 180°, FIG. 5(*f*) illustrates a case of 225°, FIG. 5(*g*) illustrates a case of 270°, and FIG. 5(*h*) illustrates a case of 315°. The rotational direction R (arrow) in FIG. 5 indicates the direction in which the liner part 6A rotates (the clockwise direction in a rear side view).

When the brushless motor 3 is driven and the rotation of the rotational shaft 31 is transmitted to the oil pulse unit 6 via the speed reducing mechanism 5, the liner part 6A begins rotating in the rotational direction R. At this time, during the time period for which the load applied to the main shaft 64 of the striking shaft part 6B is nonexistent or small (for example, during the time period from the start of a tightening operation until the wood screw, bolt, or the like becomes seated), the liner part 6A and striking shaft part 6B rotate together by only resistance of the oil contained in the liner chamber 61*a*.

However, when a large load is applied to the main shaft 64 (for example, when the wood screw, bolt, or the like becomes seated), only the liner part 6A rotates while the striking shaft part 6B does not rotate together with the liner part 6A. When the liner part 6A begins rotating alone and reaches the state of FIG. 5(*a*) (the relative rotation angle of 0°), the first protrusion 61C of the liner part 6A faces the first seal projecting part 64B of the striking shaft part 6B (the main shaft 64) and the second protrusion 61D faces the second seal projecting part 64C across their entire lengths in the front-rear direction, and the first projecting part 61A contacts the first blade 65 and the second projecting part 61B contacts the second blade 66 across their entire lengths in the front-rear direction. With this configuration, the liner chamber 61*a* enters a compartmentalized state in which the liner chamber 61*a* is divided into four liner compartments 61*b*, 61*c*, 61*d*, and 61*e*, as illustrated in FIG. 5(*a*).

As the brushless motor 3 continues to rotate from the state in FIG. 5(*a*), the capacity of each of the two liner compartments 61*b* and 61*d* decreases and thus the oil in the liner compartments 61*b* and 61*d* are compressed, thereby momentarily raising the oil pressure in these two chambers. This momentary rise in oil pressure creates a pressure difference between the liner compartments 61*b* and 61*d* and the liner compartments 61*c* and 61*e* and applies pressure in the rotational direction R to the side surface on the upstream side of the rotational direction R of each of the first blade 65 and second blade 66. As a result, a rotational force for rotating the main shaft 64 in the rotational direction R is produced momentarily, and a strong rotary impact force (torque) in the rotational direction R is produced in the main shaft 64 (the striking shaft part 6B). Note that a torque adjusting mechanism (not illustrated) is provided in the main cylindrical part 61 of the liner part 6A for controlling this momentary rise in oil pressure in order to adjust the tightening torque.

When the liner part 6A rotates further relative to the striking shaft part 6B following the instant that the rotary impact force was generated in the main shaft 64, the states in which the first seal projecting part 64B faces the first protrusion 61C, the second seal projecting part 64C faces the second protrusion 61D, the first blade 65 contacts the first projecting part 61A, and the second blade 66 contacts the second projecting part 61B are all eliminated. Thus, the compartmentalized state of the liner chamber 61*a* that was divided into four chambers is dissolved, and the liner chamber 61*a* enters a non-compartmentalized state. In the non-compartmentalized state, the oil pressure is uniform inside the liner chamber 61*a* and a force of pressure does not act on the first blade 65 and second blade 66. Accordingly, a rotary impact force is not produced in the main shaft 64, and the liner part 6A continues to rotate alone. Note that, from the moment at which a rotary impact force is produced by the liner chamber 61*a* entering the compartmentalized state until the liner chamber 61*a* enters the non-compartmentalized state, the rotary impact force continues to be produced in the main shaft 64.

As the liner part 6A continues to rotate after the liner chamber 61*a* has entered the non-compartmentalized state, the liner part 6A passes through the state of FIG. 5(*b*) (the relative rotation angle of 45°) and reaches the state of FIG. 5(*c*) (the relative rotation angle of 90°) while the non-compartmentalized state is maintained. When the liner part 6A reaches this state, the first blade 65 contacts the first protrusion 61C and the second blade 66 contacts the second protrusion 61D. Through this contact, the first blade 65 and second blade 66 are retracted inward in the radial directions until the portions of the first blade 65 and second blade 66 that had protruded radially outward from the main shaft 64 are entirely accommodated in the shaft through-hole 64*b*. In this state, the first blade 65 and second blade 66 are no longer impacted by oil pressure, and the liner part 6A continues to rotate without a rotary impact force being produced in the main shaft 64.

As the liner part 6A continues to rotate from the state in FIG. 5(*c*), the liner chamber 61*a* again enters the non-compartmentalized state and then the liner part 6A passes through the state in FIG. 5(*d*) (the relative rotation angle of 135°) and reaches the state in FIG. 5(*e*) (the relative rotation angle of 180°). When the liner part 6A reaches the state of FIG. 5(*e*), the first protrusion 61C of the liner part 6A faces the third seal projecting part 64D of the striking shaft part 6B (the main shaft 64) and the second protrusion 61D faces the fourth seal projecting part 64E across their entire lengths in the front-rear direction, and the first projecting part 61A contacts the second blade 66 and the second projecting part 61B contacts the first blade 65 across their entire lengths in the front-rear direction. Through this contact, the liner chamber 61*a* is again divided into the four liner compartment 61*b*, liner compartment 61*c*, liner compartment 61*d*, and liner compartment 61*e* (the compartmentalized state), as illustrated in FIG. 5(*e*). When the liner part 6A rotates farther relative to the striking shaft part 6B from this state, a rotary impact force is again produced.

As the liner part 6A further rotates after the generation of the rotary impact force, the liner chamber 61*a* returns to the non-compartmentalized state and the liner part 6A arrives at the state in FIG. 5(*g*) (the relative rotation angle of 270°) via the state of FIG. 5(*f*) (the relative rotation angle of 225°). When the liner part 6A reaches this state, the first protrusion 61C contacts the second blade 66, the second protrusion 61D contacts the first blade 65, and the portions of the first blade 65 and second blade 66 that protruded radially outward from the main shaft 64 are again wholly accommodated in the shaft through-hole 64*b*. Accordingly, as in the state of FIG. 5(*c*), the first blade 65 and second blade 66 are no longer affected by oil pressure and the liner part 6A continues to rotate without a rotary impact force being produced in the main shaft 64.

When the liner part 6A further rotates from the state of FIG. 5(*g*), the liner chamber 61*a* returns to the non-compartmentalized state and the liner part 6A arrives at the state in FIG. 5(*a*) (the relative rotation angle of 0°) via the state of FIG. 5(*h*) (the relative rotation angle of 315°). As the liner part 6A continues to rotate thereafter, the process described above is repeated, with two rotary impact forces (intermittent rotary impact forces) being produced each time the liner part 6A performs one rotation relative to the striking shaft part 6B (each time the liner part 6A rotates 360° relative to the striking shaft part 6B). These intermittently generated rotary impact forces causes the end bit held in the main shaft 64 to intermittently apply an impact in the rotational direction R (rotary impact) to the wood screw, bolt, or the like, thereby tightening the wood screw, bolt, or the like against the member to be fastened. In this way, the oil pulse unit 6 converts the rotational force of the rotational shaft 31 (the rotor 32) in the brushless motor 3 to intermittent rotary impact forces and outputs these forces, thereby performing an operation for tightening a wood screw, bolt, or the like using these intermittent rotary impact forces. The oil pulse unit 6 is an example of the "impact mechanism" in the present invention. Further, the end bit is an example of the "end bit" in the present invention. The retaining hole 64*a* formed in the front portion of the main shaft 64 in which the end bit is inserted is an example of the "end-bit holding part" in the present invention.

Next, the electrical structure of the oil pulse driver 1, and specifically the electrical structure of the brushless motor 3, annular circuit board 4, and control board unit 7 will be described in detail with reference to FIG. 6. FIG. 6 is a circuit diagram that includes a block diagram illustrating the electrical structure of the oil pulse driver 1.

As illustrated in FIG. 6, the rotor 32 of the brushless motor 3 is provided with two sets of permanent magnets 32A, with each set comprising a N-pole and a S-pole. The stator windings 33A of the stator 33 include three phase windings U, V, and W that are star-connected. The windings U, V, and W are each connected to the annular circuit board 4.

The annular circuit board 4 is provided with an inverter circuit 41, and three Hall ICs 42. In addition, the control board unit 7 is provided with a control power supply circuit 71, a current detecting circuit 72, a voltage detecting circuit 73, a rotated position detecting circuit 74, a rotational speed detecting circuit 75, a drive signal outputting circuit 76, and a control unit 77.

The inverter circuit 41 supplies power from the battery pack P to the brushless motor 3. The inverter circuit 41 is connected between the positive connection terminal 23B and negative connection terminal 23C and the brushless motor 3. The inverter circuit 41 has six switching elements, i.e., FETs 41A-41F. The six FETs 41A-41F are connected in a three-phase bridge configuration. The gates of the six FETs 41A-41F are connected to the drive signal outputting circuit 76, while the drains or sources are connected to the windings U, V, and W of the brushless motor 3. The FETs 41A-41F switch the power (voltage) supplied to the brushless motor 3. More specifically, the FETs 41A-41F perform switching operations for rotating the rotor 32 in a prescribed direction based on drive signals (gate signals) outputted from the drive signal outputting circuit 76. The three Hall ICs 42 are disposed at positions on the front surface of the annular circuit board 4 facing the rotor 32 and output a high signal or a low signal to the rotated position detecting circuit 74 based on the rotated position of the rotor 32. Any one of the FETs 41A-41F is an example of the "switching element" in the present invention.

The control power supply circuit 71 is a constant-voltage power supply circuit that supplies a control power supply to each circuit. In the present embodiment, the control power supply circuit 71 is configured to convert the voltage across the positive connection terminal 23B and negative connection terminal 23C (the voltage of the battery pack P) to 5 V (control voltage) and to apply this voltage to the circuits.

The current detecting circuit 72 detects the electric current (motor current) flowing in the brushless motor 3 by acquiring the value of voltage drop in a shunt resistor 1A disposed between the inverter circuit 41 and negative connection terminal 23C and outputs a signal based on the detected motor current (current value signal) to the control unit 77. The current detecting circuit 72 is an example of the "current detecting unit" in the present invention.

The voltage detecting circuit 73 is connected between the positive connection terminal 23B and negative connection terminal 23C. The voltage detecting circuit 73 detects the voltage applied to the brushless motor 3 (voltage applied across the positive connection terminal 23B and negative connection terminal 23C) and outputs a signal specifying the detected voltage (voltage value signal) to the control unit 77.

The rotated position detecting circuit 74 detects the rotated position of the rotor 32 based on high signals or low signals outputted from each of the three Hall ICs 42 and outputs a signal specifying the detected rotated position (rotated position signal) to each of the rotational speed detecting circuit 75 and control unit 77.

The rotational speed detecting circuit 75 calculates the rotational speed of the rotor 32 based on the rotated position signals outputted from the rotated position detecting circuit 74 and outputs a signal specifying the calculated rotational speed (rotational speed signal) to the control unit 77.

The drive signal outputting circuit 76 is connected to the gates of all six FETs 41A-41F and the control unit 77. The drive signal outputting circuit 76 outputs a drive signal to each gate of the FETs 41A-41F based on control signals outputted from the control unit 77.

The control unit 77 is provided with an arithmetic section (not illustrated) having a central processing unit (CPU) for performing arithmetic operations based on a process program and various data used for drive control of the brushless motor 3; ROM (not illustrated) for storing the process program and various data, various threshold values, and the like; a storage section having RAM (not illustrated) for temporarily storing data; and a time-measuring section for measuring time. The control unit 77 is a microcomputer in the present embodiment.

The control unit 77 forms control signals for sequentially switching FETs to be placed in a conducting state among the FETs 41A-41F based on the rotated position signal outputted from the rotated position detecting circuit 74 and outputs these control signals to the drive signal outputting circuit 76. Through this operation, prescribed windings are sequentially energized in the windings U, V, and W, thereby rotating the rotor 32 in a prescribed direction. In this example, drive signals for driving (switching on) the FETs 41D-41F connected to the negative power side (minus line) are outputted as pulse width modulation (PWM) signals. The PWM drive signals are signals whose duty ratio can be changed. In pulse width modulation (PWM control), the average outputted voltage is switched by changing the magnitude of the duty ratio, which is the pulse width. Increasing the duty ratio increases the average voltage supplied (applied) to the brushless motor 3, while decreasing the duty ratio decreases the average voltage supplied (applied) to the brushless motor 3. The average voltage supplied to the brushless motor 3 according to pulse width modulation (PWM control) is an example of the "voltage supplied to the motor" in the present invention. The control unit 77 is an example of the "control unit" in the present invention.

Next, drive control of the brushless motor 3 performed by the control unit 77 will be described.

In the drive control of the brushless motor 3 by the control unit 77, the control unit 77 performs constant-current control, in which the control unit 77 modifies the duty ratio based on the motor current to control the motor current so that the motor current will be equal to a target current value. When the motor current exceeds a prescribed current threshold value (current threshold value I2), the control unit 77 determines that a fastening member, such as the bolt, applying excessive load to the brushless motor 3 (the liner part 6A) when seated has become seated on the member to be fastened, and performs special control for after a bolt is seated (S108-S110 described later).

In the present embodiment, the target current value is set while accounting for the heat-resistant temperatures and the like of the brushless motor 3 and the FETs 41A-41F so that the maximum amount that the motor current other than during rotary impacts fluctuates above and below the target current value does not produce an excessive rise in temperature in the brushless motor 3 and the FETs 41A-41F (so that the motor current does not reach a value that produces an excessive rise in temperature). The target current value is 25 A in the present embodiment, but the target value is not limited to this value and should be set with consideration for the heat-resistant temperatures and the like of the motor and switching elements being used so that the motor current does not reach a current value that could cause an excessive rise in temperature.

Further, under this constant-current control, the control unit 77 increases or decreases the duty ratio by a designated amount in each process for modifying the duty ratio without performing PID feedback control or other control employing a high gain setting. In the present embodiment, the designated amount described above is 1%, and the control unit 77 performs a process for modifying the duty ratio approximately every millisecond. Consequently, the followability of the motor current to the target current value is slower than in PID feedback control and the like using a high gain setting, and the motor current rises and falls gently about the target current value.

In the present embodiment, followability to the target current value is set lower than that in PID feedback control and the like with a high gain setting in order to reliably determine the seating of the bolt while suppressing a decline in tightening performance. Specifically, if constant-current control having high followability to the target current value were performed, the duty ratio would decrease abruptly in response to the sharp rise in motor current during a rotary impact, resulting in a decline in tightening performance. By using constant-current control with lower followability in the present embodiment, a decline in tightening performance can be suppressed as the duty ratio is not decreased abruptly.

Further, if constant-current control having high followability to the target current value were employed, the duty ratio would be abruptly decreased in response to the sharp rise in motor current occurring after the bolt becomes seated on the member to be fastened. Consequently, the motor current would be reduced to a value near the target current value before the motor current surpasses the current threshold value I2, and it would not be possible to determine (judge) the bolt seating reliably. However, by using constant-current control configured with lower followability in the present embodiment, the duty ratio is not abruptly reduced in response to a sharp rise in motor current occurring when the bolt becomes seated on the member to be fastened. Accordingly, the motor current is not reduced to a value near the target current value prior to the motor current exceeding the current threshold value I2, enabling reliable determinations of bolt seating. Further, since the motor current gently fluctuates above and below the target current value when using the constant-current control of the present embodiment, this control can suppress deterioration in the tightening feeling caused by fluctuations in motor current (changes in the duty ratio). While lower followability in the constant-current control of the present embodiment is achieved by increasing or decreasing the duty ratio by the designated amount (1%) each time the duty ratio is modified, lower followability may be achieved using PID feedback control or the like with the gain set to a suitable value.

Figure 7:
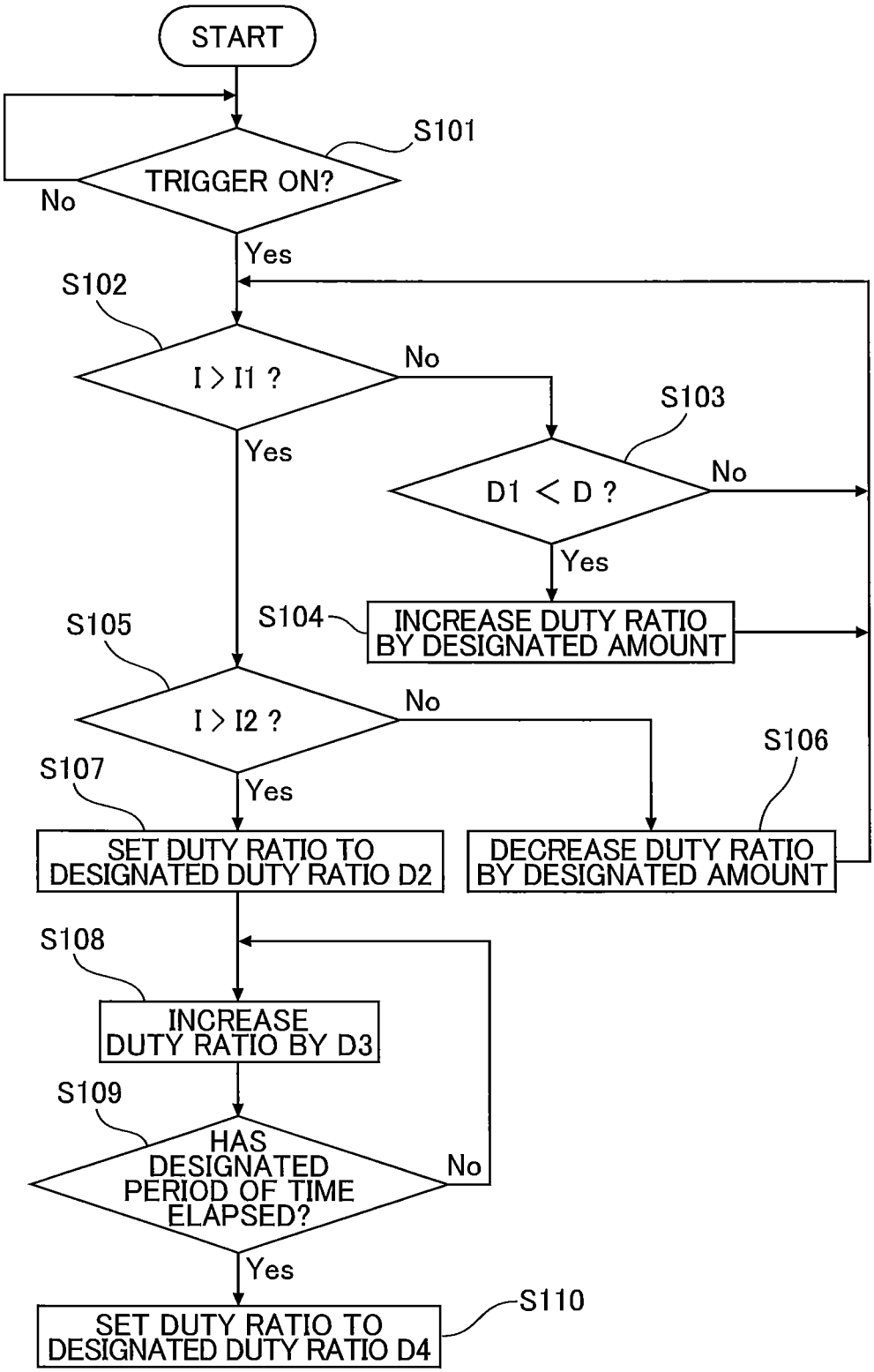
FIG. 7 is a flowchart illustrating drive control of a brushless motor performed by a control unit of the oil pulse driver according to the embodiment of the present invention.

Next, detailed steps in the process for the drive control performed by the control unit 77 will be described. FIG. 7 is a flowchart illustrating the drive control of the brushless motor 3 performed by the control unit 77.

When the battery pack P is connected to the battery connector 23A and power is supplied to the control unit 77 from the control power supply circuit 71, the control unit 77 initiates the drive control. When starting the drive control, in S101 the control unit 77 determines whether the trigger switch 22A has been switched on. This determination is made based on whether a start signal has been inputted into the control unit 77 from the switch mechanism 22B. When a start signal has been inputted into the control unit 77, the control unit 77 determines that the trigger switch 22A has been switched on.

When the control unit 77 determines in S101 that the trigger switch 22A has not been switched on (S101: NO), the control unit 77 repeats the determination in S101. In other words, the control unit 77 repeatedly performs the determination in S101 while waiting until the user switches on the trigger switch 22A.

When the control unit 77 determines in S101 that the trigger switch 22A has been switched on (S101: YES), the control unit 77 begins driving the brushless motor 3 and in S102 determines whether a current I flowing in the brushless motor 3 (hereinafter called the motor current I) exceeds a current threshold value I1. The control unit 77 detects the motor current I based on a current value signal outputted by the current detecting circuit 72. In the present embodiment, the current threshold value I1 is the target current value for constant-current control, which is 25 A as described above.

When the control unit 77 determines that the motor current I is not greater than the current threshold value I1 (S102: NO), the control unit 77 determines in S103 whether a current duty ratio D1, which is the duty ratio during the process of S103, is less than a prescribed value D (100% in the present embodiment).

When the control unit 77 determines in S103 that the current duty ratio D1 is less than the prescribed value D (S103: YES), in S104 the control unit 77 increases the duty ratio by the designated amount (1%) and subsequently returns to S102. When the control unit 77 determines that the current duty ratio D1 is not less than the prescribed value D (S103: NO), the control unit 77 returns to S102 without increasing the duty ratio. Here, increasing the duty ratio by 1% signifies that a duty ratio of 80%, for example, is set to 81% and does not signify that the duty ratio is increased by 1% of the current duty ratio D1.

On the other hand, when the control unit 77 determines in S102 that the motor current I exceeds the current threshold value I1 (S102: YES), in S105 the control unit 77 determines whether the motor current I exceeds a current threshold value I2. The current threshold value I2 is a threshold value for distinguishing the type of fastening member that is seated on the member to be fastened. When the motor current I exceeds the current threshold value I2, the control unit 77 determines that the fastening member is a bolt-like fastening member that applies excessive load to the main shaft 64 when the screw head becomes seated on the member to be fastened. However, when the motor current I does not exceed the current threshold value I2, the control unit 77 determines that the fastening member is a fastening member, such as a wood screw, which increases load applied to the main shaft 64 after the screw head becomes seated on the member to be fastened, but continues to sink into the member to be fastened. The current threshold value I2 is an example of the "discrimination threshold value" in the present invention. Further, the fastening operation on a wood screw is an example of the "first work operation" in the present invention. Further, the part of a fastening operation on a bolt prior to the bolt becoming seated is an example of the "first operation" in the present invention, while the part of the fastening operation on a bolt after the bolt becomes seated is an example of the "second work operation" in the present invention.

When the control unit 77 determines in S105 that the motor current I does not exceed the current threshold value I2, in other words, when the motor current I is greater than the current threshold value I1 but less than the current threshold value I2 (S105: NO), in S106 the control unit 77 decreases the duty ratio by the designated amount (1%) and subsequently returns to S102. Here, decreasing the duty ratio by 1% signifies that a duty ratio of 80%, for example, is set to 79%, and does not signify that the duty ratio is decreased by 1% of the current duty ratio D1.

Thus, in S102-S105, the control unit 77 decreases the duty ratio by 1% when the motor current I exceeds the current threshold value I1 and increases the duty ratio by 1% within a range not greater than the upper limit of the prescribed value D when the motor current I is less than or equal to the current threshold value I1, as long as the motor current I does not exceed the current threshold value I2. Hence, the process in S102-S105 serves to gradually raise and lower the motor current I around the target current value.

When the control unit 77 determines in S105 that the motor current I exceeds the current threshold value I2, i.e., when the control unit 77 determines that a bolt-like fastening member has become seated (bolt seating), in S107 the control unit 77 sets the duty ratio to a designated duty ratio D2. In the present embodiment, the designated duty ratio D2 is 80%. The value of the voltage supplied to the brushless motor 3 at the designated duty ratio D2 is an example of the "first prescribed value" in the present invention.

After setting the duty ratio to the designated duty ratio D2 in S107, in S108 the control unit 77 increases the duty ratio by a designated value D3 (0.025% in the present embodiment), and in S109 determines whether a designated period of time has elapsed since the determination of S105. When the control unit 77 determines in S109 that the designated period of time (800 ms in the present embodiment) has not elapsed, the control unit 77 repeats S108 and S109 while increasing the duty ratio by the designated value D3 for each process of S108. Since the repetition period of S108 and S109 is 1 ms and the designated period of time is 800 ms in the present embodiment, by setting the designated value D3 to 0.025%, the duty ratio will increase from 80% to 100% during the designated period of 800 ms. The designated period of time in S109, i.e., 800 ms, is an example of the "prescribed period of time" in the present invention. The value of the voltage supplied to the brushless motor 3 at the duty ratio of 100% after the designated period of time has elapsed is an example of the "second prescribed value" in the present invention.

When the control unit 77 determines in S109 that the designated period of time has elapsed, in S110 the control unit 77 sets the duty ratio to a designated duty ratio D4 (20% in the present embodiment). The value of the voltage supplied to the brushless motor at the duty ratio D4 is an example of the "third prescribed value" in the present invention.

The process of S107-S110 sets the duty ratio initially to 80% when determining that bolt seating has occurred (S105: YES), increases the duty ratio from 80% to 100% over the period of 800 ms, and subsequently decreases the duty ratio to 20%.

According to the process of S107-S110, the duty ratio is set to 20% after 800 ms has elapsed from a time when a bolt has become seated. This process can prevent a large current from flowing for a long duration after bolt seating, thereby suppressing a rise in temperature in the brushless motor 3 or FETs 41A-41F. Further, by initially dropping the duty ratio to 80% after bolt seating and subsequently increasing the duty ratio to 100% over 800 ms, this process can better suppress a rise in temperature in the brushless motor 3 and FETs 41A-41F than a configuration for performing a tightening operation at a duty ratio of 100% over a period of 800 ms following bolt seating. Here, the designated period of 800 ms is a period of time in which a bolt can be reliably tightened in the member to be fastened after bolt seating. Note that numerical values given above are merely examples. The designated period of time is not limited to 800 ms, but may be any period of time in which a bolt can be reliably tightened in the member to be fastened following bolt seating. Further, the designated duty ratio D2 and designated value D3 are not limited to 80% and 0.025%, respectively provided that the duty ratio is increased from a value less than or equal to 100% to a value of 100% over the designated period of time after a bolt is seated. The designated duty ratio D2 and designated value D3 should be calculated with consideration for the repetition period of the S108 and S109.

Once the duty ratio is set to 20% in S110, the control unit 77 maintains the duty ratio at 20% until the user switches off the trigger switch 22A. When the trigger switch 22A is switched off, the control unit 77 stops driving the brushless motor 3, returns to S101, and once again waits until the trigger switch 22A is switched on. While not indicated in the flowchart of FIG. 7, when the trigger switch 22A is switched off after step S102, the control unit 77 stops driving the brushless motor 3, returns to S101, and waits until the trigger switch 22A is switched on.

Figure 8:
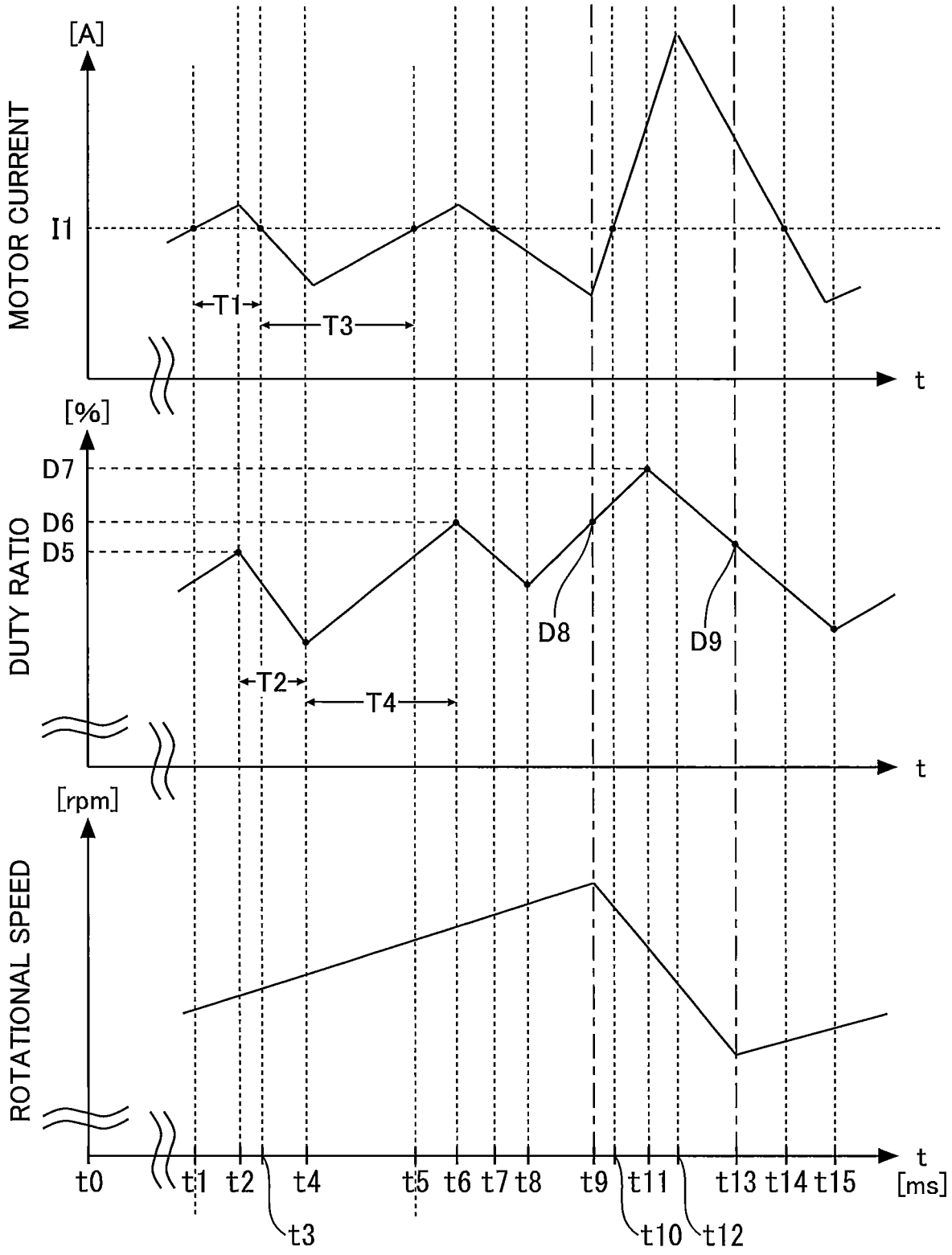
FIG. 8 is a time chart illustrating variations over time in a motor current, duty ratio, and rotational speed of the brushless motor in a case in which the drive control is performed by the control unit of the oil pulse driver according to the embodiment of the present invention.

Here, changes over time in the motor current, duty ratio, and rotational speed of the brushless motor 3 (the rotational shaft 31) will be described with reference to FIG. 8 for a case in which the control unit 77 performs the drive control when a wood screw is used as the fastening member. FIG. 8 is a time chart showing variations over time in the motor current, duty ratio, and rotational speed of the brushless motor 3 and illustrates a time period between the start of one rotary impact and the end of the next rotary impact after the tightening operation for a wood screw has begun. Note that timing t0 in FIG. 8 denotes the timing at which the drive of the brushless motor 3 is begun, and timing t1 denotes the timing just after a rotary impact ends and the liner part 6A begins to rotate relative to the striking shaft part 6B.

To begin with, the variations over time in the motor current I and the rotational speed of the brushless motor 3 (the rotational speed of the liner part 6A relative to the striking shaft part 6B) will be described.

As illustrated in FIG. 8, through the drive control by the control unit 77, the motor current I rises and drops gently around the current threshold value I1 (the target current value) after the rotary impact is completed, and the rotational speed increases owing to the motor current I flowing in the brushless motor 3. The rotational speed abruptly decreases at timing t9 coinciding with the start of the next rotary impact and accordingly the motor current I increases sharply. However, by virtue of the duty ratio decreasing process described above performed by the control unit 77 (the repetition of S102, S105, and S106), the motor current I begins to decline near timing t12 during the rotary impact. Although the motor current I begins to gradually decrease during the rotary impact, the motor current I still exceeds the current threshold value I1 at the timing t13, at which the rotary impact has ended and the rotational speed begins to increase once again. The motor current I continues to decline thereafter, but starts to rise again around timing t15.

Next, changes in the duty ratio over time will be described in association with processing in the control unit 77.

Following completion of a rotary impact, the duty ratio shifts repeatedly between an increasing period and a decreasing period under the drive control by the control unit 77 described above. In other words, following completion of a rotary impact, the voltage applied (supplied) to the brushless motor 3 repeatedly shifts between an increasing period and a decreasing period. Specifically, in the period of time from timing t1 at which the motor current I surpasses the current threshold value I1 to timing t3 at which the motor current I becomes less than or equal to the current threshold value I1 (the period of time T1), the control unit 77 repeatedly performs the duty ratio decreasing process described above (repetitions of S102, S105, and S106). The duty ratio begins to decrease from timing t2 as a delayed reflection of these processes and continues decreasing until timing t4 (the period of time T2, a decreasing period).

On the other hand, in the period of time from timing t3 at which the motor current I becomes lower than or equal to the current threshold value I1 as a reflection of the duty ratio decreasing processes to timing t5 at which the motor current I once again surpasses the current threshold value I1 (the period of time T3), the control unit 77 performs the duty ratio increasing process described above (repetitions of S102, S103, and S104). The duty ratio begins to increase from timing t4 as a delayed reflection of these processes and continues increasing until timing t6 (the period of time T4, an increasing period). Here, the reflection of the duty ratio decreasing processes performed in the period of time T1 by the control unit 77 is delayed until timing t2 and the reflection of the duty ratio increasing processes performed in the period of time T3 by the control unit 77 is delayed until timing t4 because a prescribed period is required until the FETs 41A-41F of the inverter circuit 41 can be driven after the processes are performed by the control unit 77.

In this way, the duty ratio repeatedly alternates between an increasing period and a decreasing period through the processes performed by the control unit 77, and a rotary impact starts at the timing t9. That is, a rotary impact force is produced in the oil pulse unit 6 at the timing t9. After the rotary impact begins, the motor current I once again surpasses the current threshold value I1 at the timing t10, and the control unit 77 resumes the duty ratio decreasing processes. The duty ratio begins to decrease as a delayed reflection of these processes at the timing t11 during the rotary impact. Thereafter, the duty ratio continues to decrease, even after the timing t13 at which the rotary impact ends, and subsequently reenters an increasing period, and the above process is repeated. Note that a duty ratio D8 at the start of the impact (the timing t9) is greater than a duty ratio D9 at the end of the impact (the timing t13).

Further, according to the drive control by the control unit 77, local maxima D5, D6, and D7 of the duty ratio when the duty ratio changes from an increasing period to a decreasing period gradually increase. That is, the local maximum D7 is greater than the local maximum D6, and the local maximum D6 is greater than the local maximum D5. The reason for this is that the rate of increase (the rising slope) of the motor current I when the motor current I is increased by the duty ratio increasing processes performed by the control unit 77 is smaller than the rate of decrease (the falling slope) of the motor current I when the motor current I is decreased by the duty ratio decreasing processes, and the increasing period (the period of time T4, for example) is longer than the decreasing period (the period of time T2, for example). One factor in the rate of increase of the motor current I in response to the duty ratio increasing processes being smaller than the rate of decrease of the motor current I in response to the duty ratio decreasing processes is that the load applied to the brushless motor 3 becomes smaller as the rotational speed of the brushless motor 3 increases, making the motor current I less prone to rise to the current threshold value I1. Since the length of time that the duty ratio rises increases as the time required for the motor current I to rise to the current threshold value I1 increases, the local maxima D5, D6, and D7 of the duty ratio gradually increase. The period of time T4 is an example of the "increasing period" in the present invention, and the period of time T2 is an example of the "decreasing period" in the present invention.

The microcomputer constituting the control unit 77 in the present embodiment has limitations in processing speed. Accordingly, during the series of operations for intermittently producing a plurality of rotary impacts, three local maxima D5, D6, and D7 of the duty ratio are produced between the end of one rotary impact and the start of the next rotary impact. However, if the control unit 77 were configured with a microcomputer having a faster processing speed, the control unit 77 would switch more frequently between the duty ratio increasing processes and the duty ratio decreasing processes, thereby increasing the number of local maxima of the duty ratio produced during a time period from the end of one rotary impact to the start of the next rotary impact.

Further, when the control unit 77 determines in S102 that the motor current I has not surpassed the current threshold value I1, the control unit 77 increases the duty ratio by the designated amount (1%) in S104 in the present embodiment. However, the designated amount may be set larger when the difference between the motor current I and the current threshold value I1 is larger, provided that the followability of the constant-current control performed by the control unit 77 does not become high to an extent that the control unit 77 is unable to determine the bolt seating. Similarly, in S106 of the present embodiment, the control unit 77 decreases the duty ratio by the designated amount (1%) when determining in S102 that the motor current I has surpassed the current threshold value I1 and when determining in S105 that the motor current I has not surpassed the current threshold value I2. However, the designated amount may be set larger when the difference between the motor current I and current threshold value I1 is larger, provided that the followability of the constant-current control performed by the control unit 77 does not become high to an extent that the control unit 77 is unable to distinguish the bolt seating. With this configuration, the motor current I will rise and fall by smaller amounts around the current threshold value I1, and the transitions between duty ratio increasing processes and duty ratio decreasing processes will be more frequent. Accordingly, this configuration will also increase the number of local maxima of the duty ratio produced during a time period from the end of one rotary impact to the start of the next rotary impact.

When the control unit 77 switches more frequently between the duty ratio increasing processes and the duty ratio decreasing processes so that the number of local maxima of the duty ratio produced in a time period from the end of one rotary impact to the start of the next rotary impact is increased as described above, the differences between local maxima and local minima of the duty ratio decrease. Therefore, in this case, the duty ratio will increase more smoothly from the end of one rotary impact to the start of the next rotary impact. From a broad perspective of the changes in duty ratio over time, the duty ratio gradually increases as a whole in a time period from the end of one rotary impact to the start of the next rotary impact. The duty ratio can be said to gradually increase overall if the average values obtained by calculating each average of the local maximum and the ensuing local minimum of the duty ratio rise over time. This configuration can accelerate the liner part 6A to the desired rotational speed while suppressing heat generation in the brushless motor 3 and FETs 41A-41F caused by an excessive rise in the motor current I. In the present embodiment, the local maximum D5 is 90%, the local maximum D6 is 95% and the local maximum D7 is 100%, for example. The values of voltage supplied to the brushless motor 3 at the local maximum D5, the local maximum D6, and the local maximum D7 are examples of the "voltage local maxima" in the present invention.

Figure 9:
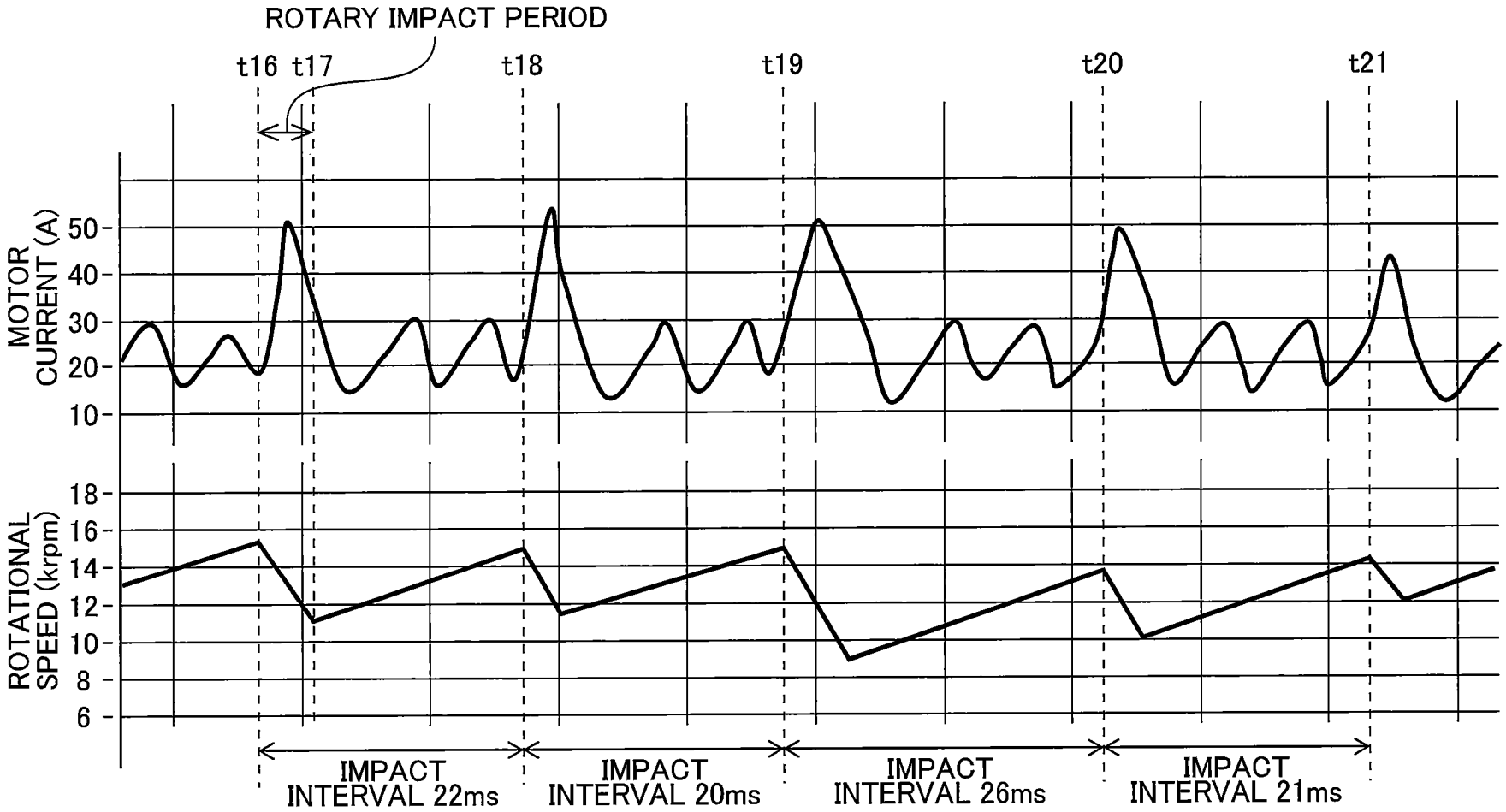
FIG. 9 is a diagram illustrating the cycle of rotary impacts occurring when the control unit of the oil pulse driver according to the embodiment of the present invention performs the drive control.

Next, the cycle of rotary impacts occurring when the drive control is performed by the control unit 77 while a wood screw is used as the fastening member will be described with reference to FIG. 9. FIG. 9 is a diagram illustrating the cycle of rotary impacts occurring when the control unit 77 performs the drive control and illustrates the changes in motor current and rotational speed over time during a period of five rotary impacts.

As illustrated in FIG. 9, the first rotary impact begins at timing t16 and ends at timing t17, and the second rotary impact begins at timing t18. Further, the third, fourth, and fifth rotary impacts begin at timings t19, t20, and t21, respectively.

The rotary impact interval between the start of the first rotary impact (timing t16) and the start of the second rotary impact (timing t18) (the rotary impact period) is 22 ms, while the rotary impact interval between the second rotary impact (timing t18) and the third rotary impact (timing t19) is 20 ms. Further, the rotary impact interval between the third rotary impact (timing t19) and the fourth rotary impact (timing t20) is 26 ms, and the rotary impact interval between the fourth rotary impact (timing t20) and the fifth rotary impact (timing t21) is 21 ms. The rotary impacts that begin from one of the timings t16, t18, t19, t20, and t21 are examples of the "first rotary impact" and "second rotary impact" in the present invention. If the rotary impact that begins from timing t19 were an example of the "first rotary impact" in the present invention, then the rotary impact that begins from timing t20 would be an example of the "second rotary impact" in the present invention.

Thus, the rotary impact intervals are irregular rather than regular when the control unit 77 performs the drive control. This is because the behavior of the motor current I and rotational speed are slightly different for each rotary impact owing to the duty ratio decreasing processes or duty ratio increasing processes performed by the control unit 77, as described above, and the period from the end of a rotary impact until the liner part 6A has rotated 180° relative to the striking shaft part 6B (i.e., the rotary impact interval) differs for each rotary impact.

Figure 10:
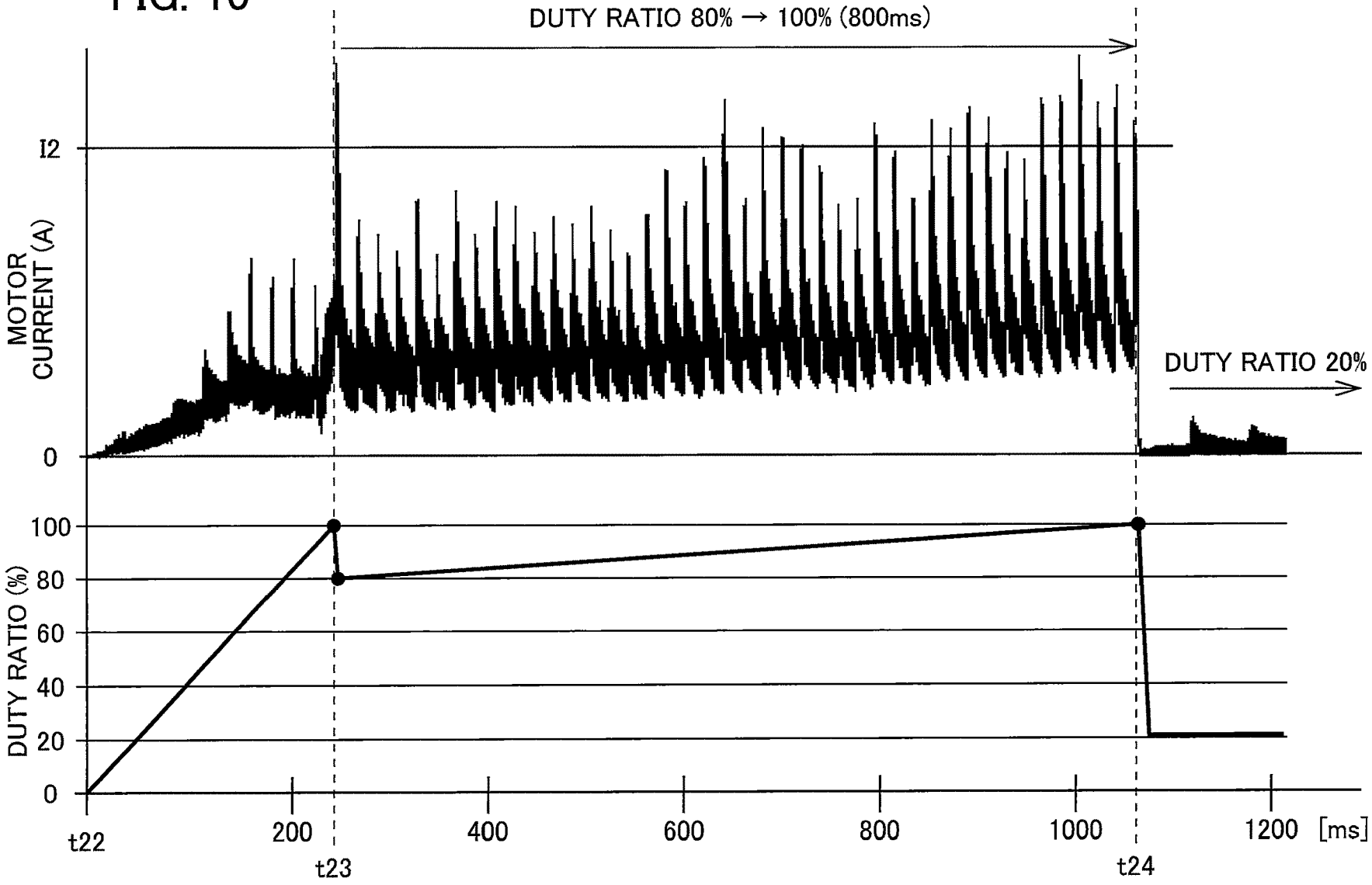
FIG. 10 is a time chart illustrating changes over time in motor current and duty ratio in a case in which the drive control is performed by the control unit of the oil pulse driver according to the embodiment of the present invention.

Next, changes in the motor current and duty ratio over time when the control unit 77 performs the drive control while a bolt is used as the fastening member will be described with reference to FIG. 10. FIG. 10 is a time chart illustrating the changes in motor current and duty ratio over time in a case in which a tightening operation is performed on a bolt. The timing t22 in FIG. 10 denotes the timing at which driving of the brushless motor 3 begins.

As illustrated in FIG. 10, several rotary impacts are performed after starting the drive of the brushless motor 3 at timing t22. When the bolt becomes seated on the member to be fastened at timing t23, the load applied to the main shaft 64 becomes extremely large, and the motor current I exceeds the current threshold value I2. When the motor current I exceeds the current threshold value I2, the control unit 77 determines that bolt seating has occurred (S105: YES) and performs the process of S107. Through this process, the duty ratio is reduced temporarily to 80%.

After reducing the duty ratio to 80%, the control unit 77 repeatedly performs the process in S108 and S109, so that the duty ratio rises from 80% to 100% over a time period of 800 ms. During this period, the motor current I gradually rises. When the duty ratio reaches 100% at timing t24 800 ms after timing t23, the control unit 77 reduces the duty ratio to 20% in the process of S110. This reduction of the duty ratio to 20% causes the motor current I to greatly drop.

As described above, the oil pulse driver 1 according to the present embodiment is provided with the brushless motor 3, the main shaft 64 that is driven by the brushless motor 3, the oil pulse unit 6 provided on the drive transmission path from the brushless motor 3 to the striking shaft part 6B and configured to produce intermittent rotary impacts that transmit the drive force of the brushless motor 3 to the main shaft 64, the FETs 41A-41F that change the voltage supplied to the brushless motor 3, and the control unit 77 that controls the FETs 41A-41F. The control unit 77 is configured such that the voltage supplied to the brushless motor 3 begins to gradually rise between the end of one rotary impact (the rotary impact beginning from timing t18, for example) and the start of the next rotary impact (the rotary impact beginning from timing t19, for example). In other words, the control unit 77 is configured to start increasing the voltage supplied to the brushless motor 3 within a period of time from the end of one rotary impact to the start of the next rotary impact and to continue gradually increasing the voltage thereafter. The driving force of the brushless motor 3 is transmitted along a path leading from the brushless motor 3 to the end bit and passing sequentially through the speed reducing mechanism 5 and oil pulse unit 6. This path is an example of the "drive transmission path" in the present invention.

The inventors of the present invention discovered that the rotational speed of the liner part 6A relative to the striking shaft part 6B just prior to the start of a rotary impact is an important factor that affects tightening performance in rotary impact tools. Therefore, in order to obtain sufficient tightening performance in the second rotary impact, it is sufficient to be able to accelerate the rotational speed of the liner part 6A relative to the striking shaft part 6B to a desired rotational speed just prior to the start of the second rotary impact, and it is not necessary to raise the duty ratio to its maximum value immediately after the end of the rotary impact. As described above, the liner part 6A can be accelerated while suppressing an excessive rise in current by configuring the control unit 77 such that the voltage supplied to the brushless motor 3 starts to gradually increase within a period of time from the end of one rotary impact to the beginning of the next rotary impact, thereby suppressing a rise in temperature in the brushless motor 3 or FETs 41A-41F while suppressing a degradation in tightening performance.

In the present embodiment, the control unit 77 is configured to start to gradually reduce the voltage supplied to the brushless motor 3 within a period of time from the start of one rotary impact to the end of the same rotary impact. In other words, the control unit 77 is configured such that the voltage supplied to the brushless motor 3 begin decreasing within a period of time from the start of a rotary impact to the end of the same rotary impact and thereafter continues to gradually decrease.

The inventors of the present invention discovered that in order to obtain sufficient tightening performance it is sufficient to produce a large torque in the motor only for a limited time period within a period of time from the start of a rotary impact to the end of the rotary impact, and it is unnecessary for the motor to produce a large torque continuously. Accordingly, a rise in temperature in the brushless motor 3 or the FETs 41A-41F can be suppressed while suppressing a decline in tightening performance by configuring the control unit 77 to begin gradually reducing the voltage supplied to the brushless motor 3 within a period of time from the start of a rotary impact to the end of the same rotary impact.

Further, the oil pulse driver 1 according to the present embodiment is provided with the brushless motor 3, the oil pulse unit 6 that is driven by the brushless motor 3 to produce rotary impacts intermittently, the FETs 41A-41F that change the voltage supplied to the brushless motor 3, and the control unit 77 that controls the FETs 41A-41F. The control unit 77 controls the voltage (the duty ratio of the PWM signal) supplied to the brushless motor 3 so that, for a period of time from the end of a rotary impact to the start of the next rotary impact, the voltage (duty ratio) supplied to the brushless motor 3 alternates repeatedly between an increasing period and a decreasing period and the local maxima of the voltage (the local maxima of the duty ratio) denoting the values of the voltage when transitioning from an increasing period to a decreasing period rise gradually (increase in the order of local maxima D5, D6, and D7 of the duty ratio).

Since the voltage supplied to the brushless motor 3 alternates repeatedly between an increasing period and a decreasing period in the above configuration, the motor current flowing in the brushless motor 3 repeatedly increases and decreases. Accordingly, this configuration can suppress a rise in temperature in the brushless motor 3 or FETs 41A-41F better than a configuration that supplies a constant large motor current by fixing the voltage supplied to the brushless motor 3 at its maximum (duty ratio of 100%). Further, since the local maxima of the voltage supplied to the brushless motor 3 gradually increase (since the local maxima D5, D6, and D7 of the duty ratio gradually increase in this sequence), sufficient voltage (power) is supplied to the brushless motor 3. Accordingly, the rotational speed of the brushless motor 3 (rotational speed of the liner part 6A relative to the striking shaft part 6B) is sufficiently increased within a period of time from the end of one rotary impact to the start of the next rotary impact, thereby obtaining a sufficient rotary impact force. This configuration can suppress a decline in tightening performance while suppressing a rise in temperature in the brushless motor 3 or FETs 41A-41F.

Further, the control unit 77 of the oil pulse driver 1 gradually decreases the duty ratio when the motor current exceeds the target current value (the current threshold value I1) and gradually increases the duty ratio when the motor current is lower than or equal to the target current value (the current threshold value I1). That is, rather than performing constant-current control with high followability, such as PID feedback control with a high gain setting, in order to bring the motor current near the target current value, the control unit 77 performs control for increasing and decreasing the duty ratio by a fixed value (1%) every millisecond. Hence, although the duty ratio is decreased to reduce the motor current when the motor current rises abruptly during a rotary impact, the degree of this reduction can be reduced, thereby suppressing a degradation in tightening performance. Note that while the control unit 77 performs control to increase and decrease the duty ratio by 1% every millisecond in the present embodiment, the present invention is not limited to this configuration. For example, the same effects can be obtained by increasing and decreasing the duty ratio by a fixed value of 5% or less every millisecond, and preferably by a fixed value between 2% and 3%.

Further, the control unit 77 in the oil pulse driver 1 decreases the duty ratio to 80% when a bolt, which applies a larger load to the brushless motor 3 than a wood screw or the like when seated on the member to be fastened, becomes seated. Thereafter, the control unit 77 increases the duty ratio from 80% to 100% over 800 ms. Therefore, this configuration can reduce the motor current in comparison to a structure for performing tightening operations on seated bolts at a fixed duty ratio of 100%, thereby suppressing a rise in temperature in the brushless motor 3 or FETs 41A-41F. This configuration can also increase the motor current more than a configuration for performing tightening operations on seated bolts at a fixed duty ratio of 80%, thereby suppressing a decline in tightening performance. In other words, this configuration can suppress a rise in temperature in the brushless motor 3 or FETs 41A-41F while suppressing a degradation in tightening performance.

Further, the control unit 77 of the oil pulse driver 1 according to the present embodiment determines that a bolt has become seated on the member to be fastened when the motor current exceeds the current threshold value I2, which is larger than the target current value (the current threshold value I1). In this way, since the current threshold value I2 that is larger than the target current value (the current threshold value I1) is used for discriminating a bolt seating, the control unit 77 can discriminate the seating of a bolt which causes, when seated, a large motor current to flow. Further, since the control unit 77 of the oil pulse driver 1 performs control for gradually decreasing the duty ratio when the motor current exceeds the target current value and for gradually increasing the duty ratio when the motor current is lower than or equal to the target current value as described above, the control unit 77 does not decrease the duty ratio too much in response to a sudden rise in motor current when the bolt becomes seated. Hence, this configuration can improve the precision for discriminating bolt seating using the current threshold value I2, without excessively suppressing a rise in motor current that accompanies the bolt seating.

Further, the control unit 77 of the oil pulse driver 1 according to the present embodiment decreases the duty ratio to 20%, i.e., lower than 80%, after 800 ms has elapsed since the bolt seating. Hence, the control unit 77 can better suppress a rise in temperature in the brushless motor 3 or FETs 41A-41F, since a large motor current does not flow after 800 ms has elapsed from the bolt seating.

Further, the control unit 77 of the oil pulse driver 1 according to the present embodiment controls the duty ratio so that the period of intermittently occurring rotary impacts is irregular. By this configuration, the period of rotary impacts does not resonate with mechanisms or the like used in the rotary impact tool, thereby reducing vibrations generated in the rotary impact tool and improving operability.

While the rotary impact tool of the invention has been described in detail with reference to a specific embodiment thereof, it would be apparent to those skilled in the art that many modifications and variations may be made therein without departing from the spirit of the invention, the scope of which is defined by the attached claims. For example, while the oil pulse driver 1 is described as an example of the rotary impact tool in the present embodiment, the present invention may be applied to an impact driver or impact wrench provided with an impact mechanism configured of a hammer and anvil.

In the present embodiment, the oil pulse driver 1 is configured to produce two rotary impacts as the liner part 6A performs one rotation relative to the striking shaft part 6B, but the present invention is not limited to this configuration. For example, the oil pulse driver 1 may be configured to produce one rotary impact for every rotation of the liner part 6A relative to the striking shaft part 6B. In this case, one rotary impact can be produced for every rotation of the liner part 6A relative to the striking shaft part 6B by eliminating the third seal projecting part 64D and fourth seal projecting part 64E.

Further, while the oil pulse driver 1 according to the present embodiment employs the brushless motor 3 and the control unit 77 controls the duty ratio of pulse width modulation (PWM control), the present invention is not limited to this configuration. For example, the control unit 77 may be configured to change the voltage supplied to a brushless motor through pulse amplitude modulation (PAM control) instead of pulse width modulation (PWM control). Further, a motor provided with brushes may be used in place of the brushless motor, and the motor may be driven by an AC power supply instead of the battery pack P. When the motor is driven by an AC power supply, the control unit 77 may be configured to control the conduction angle.

In the oil pulse driver 1 according to the present embodiment, the designated amount (1%) for increasing the duty ratio (S104) is the same value as the designated amount (1%) for decreasing the duty ratio (S106), but different values may be used for the designated amount when increasing the duty ratio (S104) and the designated amount when decreasing the duty ratio (S106).

REFERENCE SIGNS LIST

1: oil pulse driver 2: housing, 3: brushless motor, 4: annular circuit board, 5: speed reducing mechanism, 6: oil pulse unit, 6A: liner part, 6B: striking shaft part, 7: control board unit, 21: motor accommodating section, 22: handle section, 23: circuit board accommodating section, 31: rotational shaft, 33: stator, 41: inverter circuit, 64: main shaft, 72: current detecting circuit, 77: control unit, D2: designated duty ratio, D4: designated duty ratio, D5: local maximum, D6: local maximum, D7: local maximum, I1: current threshold value, I2: current threshold value, X: virtual major axis line, Y: virtual minor axis line

The invention claimed is:

1. A rotary impact tool comprising:

a motor;

an end-bit holding part driven by the motor;

an impact mechanism provided on a drive transmission path from the motor to the end-bit holding part and configured to intermittently produce rotary impacts, the rotary impacts transmitting a drive force of the motor to the end-bit holding part;

a switching element configured to change a voltage supplied to the motor; and a controller controlling the switching element, wherein the controller is configured such that the voltage supplied to the motor begins to gradually rise within a period of time from a timing when a first rotary impact ends to a timing when a second rotary impact subsequent to the first rotary impact starts, and wherein the controller is configured to start to gradually decrease the voltage supplied to the motor within a period of time from the timing when the second rotary impact subsequent to the first rotary impact starts to a timing when the second rotary impact ends.

2. The rotary impact tool according to claim 1, further comprising a current detector configured to detect a motor current flowing to the motor, wherein the controller is configured to:

when the motor current exceeds a target current value, gradually decrease the voltage supplied to the motor; and when the motor current is lower than or equal to the target current value, gradually increase the voltage supplied to the motor.

3. The rotary impact tool according to claim 2, wherein the controller is configured to:

when a first work operation is performed by an end bit connected to the end-bit holding part, control the voltage supplied to the motor as described in claim 2;

when the motor current exceeds a discrimination threshold value greater than the target current value, determine that a second work operation in which a load imposed upon the motor is larger than that in the first work operation is performed; and when the second work operation is performed:

perform a control to decrease the voltage supplied to the motor; and after performing the control, gradually increases the voltage supplied to the motor over a period of time for which a plurality of rotary impacts are produced.

4. The rotary impact tool according to claim 1, wherein the controller is configured to control the voltage supplied to the motor so that a period of the rotary impacts intermittently produced is irregular.

5. The rotary impact tool according to claim 1, A rotary impact tool comprising:

a motor;

an end-bit holding part driven by the motor;

an impact mechanism provided on a drive transmission path from the motor to the end-bit holding part and configured to intermittently produce rotary impacts, the rotary impacts transmitting a drive force of the motor to the end-bit holding part;

a switching element configured to change a voltage supplied to the motor; and a controller controlling the switching element, wherein the controller is configured such that the voltage supplied to the motor begins to gradually rise within a period of time from a timing when a first rotary impact ends to a timing when a second rotary impact subsequent to the first rotary impact starts, and wherein the controller is configured to control the voltage supplied to the motor so that, for a period of time from a timing when the first rotary impact ends to a timing when the second rotary impact starts, the voltage supplied to the motor alternates repeatedly between an increasing period and a decreasing period and voltage local maxima gradually rise, the voltage local maxima being values of the voltage at timings when the voltage transits from the increasing period to the decreasing period.

6. The rotary impact tool according to claim 5, further comprising a current detector configured to detect a motor current flowing to the motor, wherein the controller is configured to:

when the motor current exceeds a target current value, gradually decrease the voltage supplied to the motor; and when the motor current is lower than or equal to the target current value, gradually increase the voltage supplied to the motor.

7. The rotary impact tool according to claim 5, wherein the controller is configured to control the voltage supplied to the motor so that a period of the rotary impacts intermittently produced is irregular.

8. A rotary impact tool comprising:

a motor;

an end-bit holding part driven by the motor;

an impact mechanism provided on a drive transmission path from the motor to the end-bit holding part and configured to intermittently produce rotary impacts, the rotary impacts transmitting a drive force of the motor to the end-bit holding part;

a switching element configured to change a voltage supplied to the motor; and a controller controlling the switching element, wherein when a first work operation is performed by an end bit connected to the end-bit holding part, the controller is configured such that the voltage supplied to the motor begins to gradually rise within a period of time from a timing when a first rotary impact ends to a timing when a second rotary impact subsequent to the first rotary impact starts, and wherein when a second work operation in which a load imposed upon the motor is greater than that in the first work operation is performed, the controller is configured to:

perform a control to decrease the voltage supplied to the motor; and after performing the control, gradually increase the voltage supplied to the motor over a period of time for which a plurality of rotary impacts are performed.

9. The rotary impact tool according to claim 8, wherein the controller is configured to, when the second work operation is performed:

decrease the voltage supplied to the motor to a first prescribed value;

after decreasing the voltage to the first prescribed value, increase the voltage from the first prescribed value to a second prescribed value over a prescribed period of time, the second prescribed value being larger than the first prescribed value; and after the prescribed period of time elapses, decrease the voltage to a third prescribed value lower than the first prescribed value.

* * * * *